US009207574B2

(12) United States Patent
Terazawa et al.

(10) Patent No.: US 9,207,574 B2
(45) Date of Patent: Dec. 8, 2015

(54) POWDER MATERIAL CONTAINER AND IMAGE FORMING APPARATUS PROVIDED THEREWITH, AND POWDER MATERIAL REPLENISHING METHOD

(75) Inventors: Seiji Terazawa, Shizuoka (JP); Tadashi Hayakawa, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/007,778

(22) PCT Filed: Mar. 23, 2012

(86) PCT No.: PCT/JP2012/058501

§ 371 (c)(1),
(2), (4) Date: Sep. 26, 2013

(87) PCT Pub. No.: WO2012/133726

PCT Pub. Date: Oct. 4, 2012

(65) Prior Publication Data

US 2014/0064795 A1 Mar. 6, 2014

(30) Foreign Application Priority Data

Mar. 31, 2011 (JP) ..... 2011-078430
Feb. 7, 2012 (JP) ..... 2012-023809

(51) Int. Cl.
*G03G 15/08* (2006.01)

(52) U.S. Cl.
CPC ..... *G03G 15/0867* (2013.01); *G03G 15/0872* (2013.01); *G03G 15/0886* (2013.01); *G03G 2215/0668* (2013.01); *G03G 2215/0692* (2013.01)

(58) Field of Classification Search
CPC ..... G03G 15/0886
USPC ..... 399/262
See application file for complete search history.

(56) References Cited

U.S. PATENT DOCUMENTS 5,184,182 A * 2/1993 Michlin ..... 399/262
5,441,177 A 8/1995 Yanagisawa (Continued)

FOREIGN PATENT DOCUMENTS

EP 1022620 A1 7/2000
JP 2000-214669 8/2000

(Continued)

OTHER PUBLICATIONS

Combined Taiwanese Office Action and Search Report issued Aug. 12, 2014 in Patent Application No. 101110876 (with English language translation).

(Continued)

*Primary Examiner* — David Gray
*Assistant Examiner* — Geoffrey Evans
(74) *Attorney, Agent, or Firm* — Oblon, McClelland, Maier & Neustadt, L.L.P.

(57) ABSTRACT

A powder material container is disclosed, including an elongated tubular container body; and a cap which has formed a temporary containing space which is communicably connected in the longitudinal direction of the container body to an opening of the container body to temporarily contain a powder material conveyed from the opening and which has formed on a side face in the longitudinal direction of the container body a discharging hole which discharges the powder material within the temporary containing space. The powder material container includes a blocking member which can switch between a blocking state in which the powder material within the temporary containing space is blocked from passing through an inlet face of the discharging hole facing the temporary containing space and a non-blocking state in which the powder material within the temporary containing space is not blocked from passing through the inlet face of the discharging hole.

14 Claims, 14 Drawing Sheets

(56) References Cited

U.S. PATENT DOCUMENTS

| | | | | |
|---|---|---|---|---|
| 5,515,143 | A | 5/1996 | Shiotani | |
| 5,528,349 | A * | 6/1996 | Satake | 399/262 |
| 5,870,652 | A * | 2/1999 | Kanamori et al. | 399/106 |
| 6,418,292 | B1 * | 7/2002 | Isobe et al. | 399/258 |
| 7,720,416 | B2 | 5/2010 | Taguchi et al. | |
| 8,649,713 | B2 * | 2/2014 | Hori et al. | 399/262 |
| 8,655,232 | B2 * | 2/2014 | Wu et al. | 399/258 |
| 8,666,277 | B2 * | 3/2014 | Huang et al. | 399/106 |
| 2002/0031374 | A1 * | 3/2002 | Matsuda et al. | 399/258 |
| 2002/0034404 | A1 * | 3/2002 | Kojima et al. | 399/258 |
| 2004/0091288 | A1 * | 5/2004 | Yahagi | 399/258 |
| 2004/0126131 | A1 * | 7/2004 | Numagami et al. | 399/109 |
| 2004/0131383 | A1 * | 7/2004 | Fujita et al. | 399/109 |
| 2005/0207797 | A1 * | 9/2005 | Fujita et al. | 399/258 |
| 2007/0104505 | A1 * | 5/2007 | Murakami et al. | 399/106 |
| 2007/0122205 | A1 | 5/2007 | Taguchi et al. | |
| 2009/0087215 | A1 * | 4/2009 | Sakuma | 399/105 |
| 2009/0116867 | A1 | 5/2009 | Kuba | |
| 2010/0226690 | A1 | 9/2010 | Kadota et al. | |
| 2011/0002713 | A1 | 1/2011 | Taguchi et al. | |
| 2011/0008075 | A1 | 1/2011 | Taguchi et al. | |
| 2011/0262180 | A1 * | 10/2011 | Suzuki | 399/106 |
| 2012/0006446 | A1 * | 1/2012 | Isomura et al. | 141/1 |
| 2012/0099902 | A1 * | 4/2012 | Yoshida et al. | 399/262 |
| 2012/0163877 | A1 | 6/2012 | Kikuchi et al. | |
| 2014/0064794 | A1 * | 3/2014 | Takahashi et al. | 399/262 |
| 2014/0119780 | A1 * | 5/2014 | Hori et al. | 399/262 |
| 2014/0153974 | A1 * | 6/2014 | Jimba et al. | 399/262 |

FOREIGN PATENT DOCUMENTS

| | | | |
|---|---|---|---|
| JP | 2005-031109 | | 2/2005 |
| JP | 2006-071762 | | 3/2006 |
| JP | 2006-308781 | | 11/2006 |
| JP | 2007-148320 | | 6/2007 |
| JP | 2007-183448 | | 7/2007 |
| JP | 2010-066638 | | 3/2010 |
| JP | 2011-076064 | | 4/2011 |
| JP | 2012047772 | A * | 3/2012 |
| TV | I332606 | B | 11/2010 |
| WO | WO 2011/027604 | A1 | 3/2011 |

OTHER PUBLICATIONS

International Search Report Issued Apr. 24, 2012 in PCT/JP2012/058501 filed on Mar. 23, 2012.

Chinese Office Action dated Sep. 2, 2015 for corresponding Chinese Office Application No. 201280026383.9.

* cited by examiner

POWDER MATERIAL CONTAINER AND IMAGE FORMING APPARATUS PROVIDED THEREWITH, AND POWDER MATERIAL REPLENISHING METHOD

TECHNICAL FIELD

The present invention relates to a powder material container which is mounted in image forming apparatus such as a copying machine, a printer, a facsimile machine, or a multi-functional unit having functions to use the powder material container; the image forming apparatus provided with the powder material container; and a powder material replenishing method which replenishes the image forming apparatus with a powder material using the powder material container.

BACKGROUND ART

As a type of the image forming apparatus, a toner container (a toner bottle) is known which is provided in a manner such that it can be detachably mounted in an image forming apparatus body, which toner container is a tubular powder material container which contains toner (a powder material) for replenishment, for example. Many of such tubular toner bottles mainly include an elongated tubular container body and a cap. The container body, which has an opening formed on the one end side in a longitudinal direction, is configured such that contained toner is conveyed toward the opening. The cap, which is provided such that it covers the opening of the container body, has formed an internal space (a temporary containing space) which temporarily contains toner which is fed in from inside the container body via the opening. Moreover, the cap has formed on a side face in the longitudinal direction of the container body a discharge hole which discharges, to outside, toner within the internal space. Furthermore, on the discharge hole of the cap is provided a shutter member. This shutter member causes the discharge hole of the cap to be blocked from the outside of the cap when the toner container is not mounted in the image forming apparatus body. This makes it possible to prevent toner from leaking out of the discharge hole when the toner container is not mounted in the image forming apparatus body. On the other hand, when mounted in the image forming apparatus body, the shutter member causes the discharge hole of the cap to be open, making it possible to discharge the toner within the toner bottle from the discharge hole to replenish a developing apparatus (powder material using unit) of the image forming apparatus body with toner.

For configurations of conveying the toner inside the container body from the opening of the container body to the cap, various configurations are widely adopted such as, for example, a configuration in which a spiral-shaped conveying projection is formed on an inner wall face of the container body, and the container body is rotationally driven with the longitudinal direction as a rotational axis to convey the toner; a configuration in which a conveying member such as a conveying screw is provided inside the container body to convey the toner with driving of the conveying member, or a different known configuration.

In such a powder material container, when a container of a powder material such as toner is left for a certain period in a relatively high temperature environment (a warehouse, etc.) with the powder material such as the toner contained inside, for example, the powder material which is contained therein coheres, leading to reduced mobility of the powder material such as the toner, etc. More specifically, in the above-described powder material container, where the container body is elongated and a discharge hole is formed on a cap provided on an opening in the one end side in the longitudinal direction of the container body, when the powder material container is stored in a position such that it stands up with the cap facing downward, the weight of the powder material which is piled up high within the container body acts on the powder material within the cap, so that the powder material within the cap firmly coheres. As a result, the discharge hole which is provided at the cap is blocked with the powder material which is firmly cohered, so that, when the powder material container is mounted in the image forming apparatus to use the powder material container, a situation occurs in which replenishment, with the powder material from the discharge hole, of the image forming apparatus body is prevented, or there is a discharge failure.

A toner container disclosed in Patent document 1 adopts a configuration which makes it possible to improve on such a discharge failure. More specifically, in the toner container, when mounted in the image forming apparatus with the cap fixed, the container itself is rotationally driven with its longitudinal direction as the rotational axis to convey toner within the container body to the cap. At the opening of the container body is fixed an agitating member which extends into inside the cap along the longitudinal direction of the container body. A tip of the agitating member is shaped such that it builds over an inlet face of the discharge hole facing a side face inner wall of the cap. With such a configuration, the toner which is firmly cohered and which blocks the inlet face of the discharge hole is disentangled with the tip of the agitating member which is driven with a rotational drive of the container body, easing the cohering of the toner that prevents the toner from being discharged from the discharge outlet, making it possible to improve on the discharge failure caused by the cohered toner.

Now, the present inventors have found, as a result of research, a problem that the discharge failure caused by the cohering of the toner may not be suppressed sufficiently even with the toner container as disclosed in Patent document 1.

A space which corresponds to a side face wall thickness of the cap exists inside the discharging hole formed on the side face of the cap, or, in other words, between an inlet face which faces an inner wall face of the side face of the cap and an outlet face which faces an outer wall face of the side face of the cap. A tip of the agitating member in the toner container disclosed in Patent document 1 may disentangle the toner which blocks the inlet face of the discharge hole, but may not disentangle the toner which is cohered inside the discharging hole. When the side face wall thickness of the cap is sufficiently thin, a wall of the toner inside the discharging hole that prevents the toner from being discharged from the discharging hole is thin, so that there may be a case such that an impact arises which is not sufficient to produce a discharge failure. However, in terms of maintaining the strength of the cap, a certain amount of wall thickness is necessary for the side face of the cap for securing the strength of the cap, etc., so that the wall of the toner which coheres inside the discharging hole becomes thick, causing a discharge failure.

However, this problem is not limited to when the powder material is the toner.

PATENT DOCUMENT

Patent document 1: JP2006-71762A

SUMMARY OF THE INVENTION

Means for Solving the Problems

In light of the problems as described above, an object of the present invention is to provide a powder material container which makes it possible to prevent a discharge failure caused by a powder material cohering inside a discharging hole of the powder container; an image forming apparatus provided with the powder material container; and a powder material replenishing method which replenishes the powder material into the image forming apparatus using the powder material container.

In order to achieve the above object, claim 1 recites a powder material container, including an elongated tubular container body which has formed an opening on the one side in a longitudinal direction and which is arranged such that a powder material contained inside is conveyed toward the opening; and a cap which has formed therein a temporary containing space which is communicably connected in the longitudinal direction of the container body to the opening of the container body to temporarily contain the powder material conveyed from the opening and which has formed on a side face in the longitudinal direction of the container body a discharging hole which discharges the powder material within the temporary containing space to outside, the powder material container further including a blocking member which can switch between a blocking state in which the powder material within the temporary containing space is blocked from passing through an inlet face of the discharging hole facing the temporary containing space and a non-blocking state in which the powder material within the temporary containing space is not blocked from passing through the inlet face of the discharging hole.

Moreover, claim 2 recites the powder material container as claimed in claim 1, further including a shutter member which can move between an open position at which an outlet face of the discharging hole facing an outer wall face of the cap is caused to be open, and a closed position at which the outlet face of the discharging hole is caused to be blocked, wherein the blocking member is in a non-blocking state when the shutter member is in the open position, whereas the blocking member is in a blocking state when the shutter member is in the closed position.

Moreover, claim 3 recites the powder material container as claimed in claim 2, wherein, in cooperation with a movement of the shutter material from the open position to the closed position, the blocking member changes from the non-blocking state to the blocking state, and, in cooperation with a movement of the shutter material from the open position to the closed position, the blocking member changes from the blocking state to the non-blocking state.

Moreover, claim 4 recites the powder material container as claimed in claim 3, wherein the blocking member contains a rising portion which extends from an inner wall face of the shutter member to an inlet face of the discharging hole and a blocking portion which is fixed to a tip of the rising portion and which can block an inlet face of the discharging hole, wherein in cooperation with a movement of the shutter member from the open position to the closed position, the blocking portion of the blocking member moves to a blocking position at which an inlet face of the discharging hole is blocked, and, in cooperation with a movement of the shutter member from the closed position to the open position, the blocking portion of the blocking member moves to a non-blocking position at which the inlet face of the discharging hole is not blocked.

Moreover, claim 5 recites the powder material container as claimed in any one of claims 1 to 4, further comprising an agitating member which agitates the powder material within the temporary housing space in the cap.

Moreover, claim 6 recites the powder material container as claimed in claim 5, further comprising a rotational drive unit which rotationally drives upon receiving a drive force from outside, wherein rotational driving of the rotational drive unit drives the agitating member to agitate the powder material within the temporary containing space.

Moreover, claim 7 recites an image forming apparatus, to which is detachably mounted a powder material container which contains a powder material used at the time of an image forming operation, wherein the powder material container as claimed in any one of claims 1 to 6 is used as the powder material container.

Moreover, claim 8 recites a powder material replenishment method which replenishes, with the powder material from the powder material container as claimed in any one of claims 1-6, a powder material using unit of the image forming apparatus body to which is detachably mounted the powder material container, wherein, after the powder material container with the blocking member being in the blocking state is mounted in the image forming apparatus body, the blocking member is switched to the non-blocking state.

In the present embodiment, a blocking member is activated, so that it blocks a powder material within a temporary containing space of a cap from passing through an inlet face of a discharging hole, making it possible to prevent the powder material from getting into the discharging hole. Therefore, the blocking member may be activated to prevent the powder material from cohering inside the discharge hole.

In order to achieve the above-described object, the following claim is also recited:

There is a powder material container including an elongated tubular container body which has formed an opening on the one side in a longitudinal direction and which is arranged such that a powder material contained inside is conveyed toward the opening; and a cap which has formed therein a temporary containing space which is communicably connected in the longitudinal direction of the container body to the opening of the container body to temporarily contain the powder material conveyed from the opening and which has formed on a side face in the longitudinal direction of the container body a discharging hole which discharges the powder material within the temporary containing space to outside, the powder material container further including a blocking member which can switch between a blocking state in which the powder material within the temporary containing space is blocked from passing through an inlet face of the discharging hole facing the temporary containing space and a non-blocking state in which the powder material within the temporary containing space is not blocked from passing through the inlet face of the discharging hole, wherein a sealing member which seals an inlet face of the discharging hole, or an area to be sealed, which area is on the temporary containing space side relative to the inlet face, is used as the blocking member, and wherein the sealing member is in the blocking state when sealing the area to be sealed, and is in the non-blocking state when removed from the area to be sealed.

In the present embodiment, when a sealing member is activated, so that it seals an area to be sealed, the powder material within the temporary containing space of the cap is blocked from passing through the inlet face of the discharging hole, making it possible to prevent the powder material from getting into inside the discharging hole. Thus, the sealing member may be activated until use of the powder material container is started to prevent the powder material from cohering inside the discharging hole. Then, when use of the powder material container is started, the sealing member is removed from the area to be sealed, so that it is deactivated, making it possible to discharge the powder material contained inside the powder material container from the discharging hole.

Any one of the embodiments effect a suitable advantage of making it possible to prevent the cohering of the powder material inside the discharge hole, thereby making it possible to prevent a discharge failure caused by the cohered powder material inside the discharging hole.

DESCRIPTION OF THE REFERENCE NUMERALS

Figure 1:
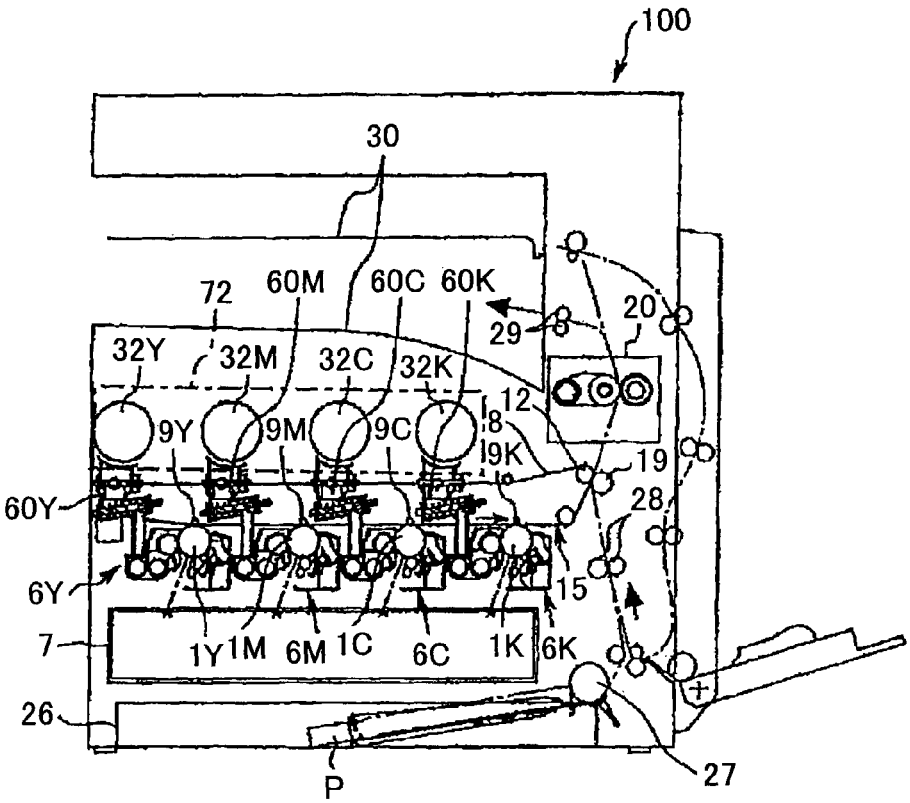
FIG. 1 is an overall configuration diagram illustrating an image forming apparatus according to one embodiment.

32 Toner container
33 Container body
33*a* Bottle inlet portion
33*b* Projection
33*c* Gear
33*d* Grip
33*f* Agitating member
34 Cap
34*d* Toner discharging hole
34*e* Compressing seal
34*m* Projection
34*t* Sliding groove
36 Shutter seal
37 Cap seal
38 Shutter
38*a* Shutter substrate
38*b* Rising portion
38*c* Visor
38*d* Rail
39 Seal
60 Toner replenishing apparatus
70 Toner container housing unit
72 Bottle receiving unit
73 Cap receiving unit
73*d* Shutter closing mechanism
73*w* Toner replenishing inlet
100 Image forming apparatus
133 Gear member
141 Conveying member
A Opening
B Cavity
C Inner space of toner discharging hole
Ca Inlet face
Cb Outlet face
W Toner discharging hole

MODE FOR CARRYING OUT THE INVENTION

A detailed description is given below with regard to one embodiment of the present invention with reference to the drawings. The same letter is affixed to the same or corresponding parts, so that a repeated explanation will be simplified or omitted as needed.

FIG. 1 is a schematic diagram showing an overview configuration of an image forming apparatus according to the present embodiment.

Toner containers 32Y, 32M, 32C, and 32K as four powder material containers that correspond to the colors yellow, magenta, cyan, and black are detachably (replaceably) mounted in a toner container housing unit 70 of an image forming apparatus 100. An intermediate transfer unit 15 is arranged at a lower part of the toner container housing unit 70. Image creating units 6Y, 6M, 6C, and 6K which correspond to the colors are installed together such that they oppose an intermediate transfer belt 8 of the intermediate transfer unit 15. Moreover, toner replenishing apparatuses 60Y, 60M, 60C, and 60K are arranged at a lower part of the toner containers 32Y, 32M, 32C, and 32K. Then, toner contained in the toner containers 32Y, 32M, 32C, and 32K is respectively supplied into developing apparatuses (powder material using units) of the image creating units 6Y, 6M, 6C, and 6K.

Figure 2:
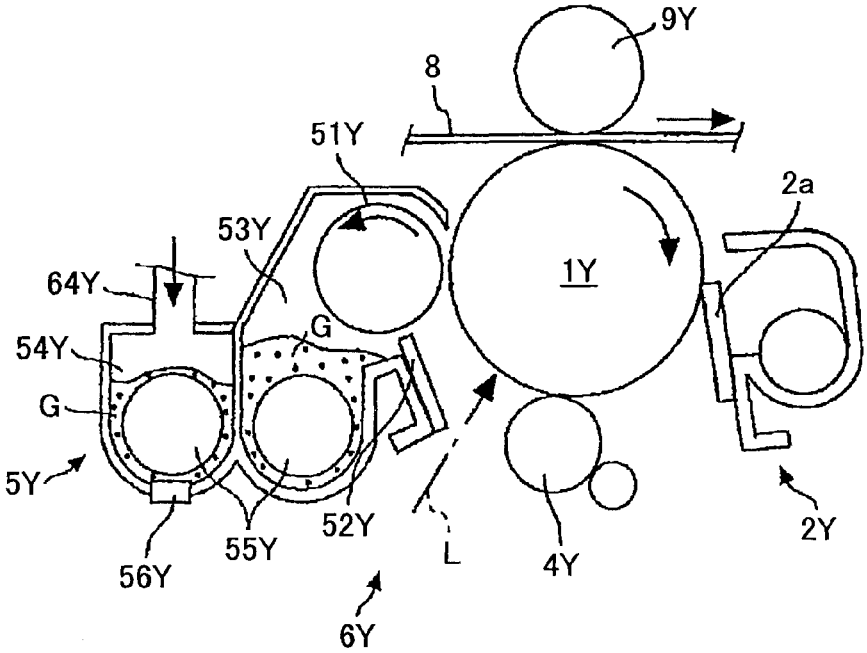
FIG. 2 is a schematic diagram illustrating an image creating unit of the image forming apparatus according to the one embodiment.

FIG. 2 is a schematic diagram showing an overall configuration of the image creating unit 6Y which corresponds to yellow.

The image creating unit 6Y includes a photoconductor drum 1Y; a charging unit 4Y, which is arranged around the photoconductor drum 1Y; a developing apparatus 5Y (a developing unit); a cleaning unit 2Y; a neutralizing unit (not shown), etc. Then, a set of image creating processes (charging, exposing, developing, transferring, and cleaning steps) is performed on the photoconductor drum 1Y, so that a yellow image is formed on the photoconductor drum 1Y.

Other than the color of the toner used being different, the other three image creating units 6M, 6C, and 6K are arranged in almost the same manner as the image creating unit 6Y corresponding to yellow, so that images corresponding to the respective toner colors are formed. Below, only the image creating unit 6Y corresponding to yellow is explained, omitting explanations of the other three image creating units 6M, 6C, and 6K as needed.

The photoconductor drum 1Y is rotationally driven in a clockwise direction shown in FIG. 2 by a drive motor (not shown). Then, at a position of the charging unit 4Y, a surface of the photoconductor drum 1Y is uniformly charged (Charging step). Then, an electrostatic latent image which corresponds to yellow is formed with scan exposing at a location of irradiation of a laser light L emitted from an exposing unit 7, which location the surface of the photo conductor drum 1Y reaches (Exposing step). Then, a toner image for yellow is formed by the electrostatic latent image being developed at a location opposing the developing apparatus 5Y, which location the surface of the photoconductor drum 1Y reaches (Developing step). Then, a toner image on the photoconductor drum 1Y is transferred onto the intermediate transfer belt 8 at a location opposing the intermediate transfer belt 8 and a first transfer bias roller 9Y, which location the surface of the photoconductor drum 1Y reaches (First transferring step). At this time, a slight amount of untransferred toner remains on the photoconductor drum 1Y. Then, the untransferred toner which remains on the photoconductor 1Y at a location which opposes the cleaning unit 2Y is mechanically collected by a cleaning blade 2*a*, which location the surface of the photoconductor drum 1Y reaches (Cleaning step). Finally, the surface of the photoconductor drum 1Y reaches a location opposing the neutralizing unit (not shown), at which location a remaining electric potential on the photoconductor drum 1Y is removed. In this way, a series of image creating processes performed on the photoconductor drum 1Y is completed.

The above-described image creating processes are also performed in the other image creating units 6M, 6C, and 6K in the same manner as in the yellow image creating unit 6Y. In other words, the laser light L which is based on image information is irradiated onto a photoconductor drum of the corresponding image creating unit 6M, 6C, and 6K from the exposing apparatus 7 arranged at a lower portion of the image creating units. More specifically, the exposing apparatus 7 emits the laser light L from an optical source to irradiate the laser light L onto a photoconductor drum via multiple optical elements while scanning with a rotationally driven polygon mirror. Then, toner images of the colors that are formed on the respective photoconductor drums via the developing step are transferred onto the intermediate transfer belt 8 such that one is overlaid on another. In this way, a color image is formed on the intermediate transfer belt 8.

The intermediate transfer unit 15 includes the intermediate transfer belt 8, four primary transfer bias rollers 9Y, 9M, 9C, 9K, a secondary transfer backup roller 12, multiple tension rollers, an intermediate transfer cleaning unit, etc. The intermediate transfer belt 8 is stretched and supported by multiple roller members and is also endlessly moved by rotational driving of the one roller members 12 in the arrow direction in FIG. 1. The intermediate transfer belt 8 is sandwiched between the four primary transfer bias rollers 9Y, 9M, 9C, and 9K and the photoconductor drums 1Y, 1M, 1C, and 1K, so that primary transfer nips are formed. Then, a transfer bias of a polarity which is reverse a polarity of the toner is applied to the primary transfer bias rollers 9Y, 9M, 9C, and 9K. Then, the intermediate transfer belt 8 travels in the arrow direction to successively pass the primary transfer nips for the respective primary transfer bias rollers 9Y, 9M, 9C, and 9K. Thus, toner images of the respective colors that are on the photoconductor drums 1Y, 1M, 1C, and 1K are primary transferred onto the intermediate transfer belt 8 such that one is overlaid on another.

Then, the intermediate transfer belt 8 having a toner image of four colors transferred with one toner image being overlaid onto another reaches a location which opposes a secondary transfer roller 19. At this location, the intermediate transfer belt 8 is sandwiched between the secondary transfer backup roller 12 and the secondary transfer roller 19, so that a secondary transfer nip is formed. Then, toner image of four colors that is formed on the intermediate transfer belt 8 is transferred onto a recording medium P such as a transfer sheet, etc., which is conveyed to the location of the secondary transfer nip. Then, untransferred toner which has not been transferred onto the recording medium P remains. Then, the intermediate transfer belt 8 reaches a location of an intermediate transfer cleaning unit (not shown). Then, at this location, untransferred toner on the intermediate transfer belt 8 is collected. In this way, a series of transfer processes performed on the intermediate transfer belt 8 is completed.

The recording medium P which is conveyed to the location of the secondary transfer nip is conveyed from a paper-supply unit 26 which is arranged at a lower part of the image forming apparatus body via a paper-supplying roller 27, a pair of registration rollers 28, etc. More specifically, the recording medium P is stored in the paper-supply unit 26 with multiple sheets of the recording medium P being overlaid. Then, when the paper-supplying roller 27 is rotationally driven in a counterclockwise direction in FIG. 1, the topmost recording medium P is supplied toward a location which is between rollers of the pair of registration rollers 28. The recording medium P, which is conveyed to the pair of registration rollers 28, stops at a location of a roller nip of the pair of registration rollers 28 which stopped rotational driving. Then, the pair of registration rollers 28 is rotationally driven, so that the recording medium P is conveyed toward the second transfer nip at timing aligned to a color image on the intermediate transfer belt 8. In this way, a desired color image is transferred onto the recording medium P.

The recording medium P, onto which the color image has been transferred at a location of the secondary transfer nip is conveyed to a location of a fixing apparatus 20. Then, the color image transferred onto the surface is fixed onto the recording medium P with heat and pressure due to a fixing belt and a pressurizing roller at this location. Then, the recording medium P is discharged out of the image forming apparatus 100 via a location which is in between rollers of a discharge roller pair 29. The transferred medium P which is discharged out of the image forming apparatus by the discharge roller pair 29 is successively stacked on a stacking unit 30 as an output image. In this way, a series of image forming processes in the image forming apparatus is completed.

Next, a configuration and an operation of a developing apparatus in an image creating unit are described in more detail.

As shown in FIG. 2, the developing apparatus 5Y includes a developing roller 51Y, which opposes the photoconductor drum 1Y; a doctor blade 52Y, which opposes the developing roller 51Y; two conveying screws 55Y arranged in developing agent containers 53Y and 54Y; a concentration detection sensor 56Y, which detects a toner concentration within the developing agent, etc. The developing roller 51Y includes a magnet which is securely installed therein and a sleeve, which rotates around the magnet, etc. Within the developing agent containers 53Y and 54Y, a two-component developing agent G which includes a carrier and toner is contained. The developing agent container 54Y is communicably connected to a toner dropping and conveying path 64Y via an opening formed at an upper portion thereof.

A sleeve of the developing roller 51Y is rotationally driven in an arrowed direction in FIG. 2. Then, the developing agent G which is borne on the developing roller 51Y due to a magnetic field formed with the magnet moves over the developing roller 51Y with a rotation of the sleeve. The developing agent G within the developing apparatus 5Y is adjusted such that a proportion of toner (toner concentration) within the developing agent falls within a predetermined range. More specifically, the toner contained in the toner container 32Y is replenished into the developing agent container 54Y via the toner replenishing apparatus 60Y. A configuration and an operation of the toner replenishing apparatus are described in detail below.

The toner replenishing the developing agent container 54Y circulates through the two developing agent containers 53Y and 54Y while being mixed and agitated with the developing agent G by the two conveying screws 55Y. Then, the toner within the developing agent G adheres to the carrier due to frictional electrification with the carrier to be borne on the developing roller 51Y together with the carrier due to a magnetic force formed over the developing roller 51Y. The developing agent G which is borne on the developing roller 51Y is conveyed in the arrowed direction in FIG. 2, so that it reaches a location of the doctor blade 52Y. Then, after being optimized for the amount thereof at this location, the developing agent G on the developing roller 51Y is conveyed to a location (a developing area) opposing the photoconductor drum 1Y, so that the toner adheres to the latent image formed on the photoconductor drum 1Y due to an electric field formed on the developing area. Then, the developing agent G which remains on the developing roller 51Y reaches an upper portion of the developing agent container 53Y with rotating of the sleeve, at which location the developing agent G leaves the developing roller 51Y.

Figure 3:
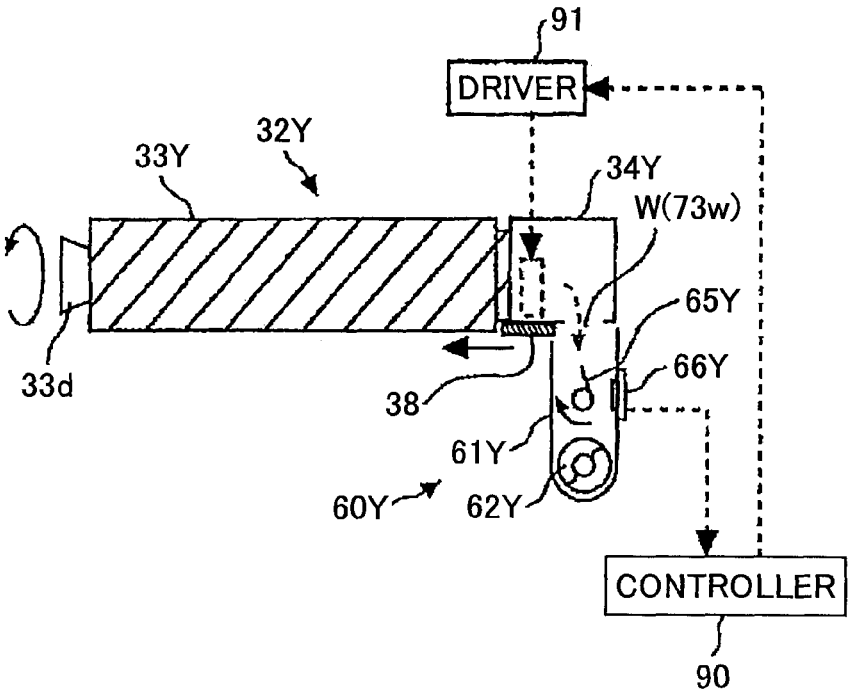
FIG. 3 is a schematic diagram which illustrates a state such that a toner replenishing apparatus in the image forming apparatus is provided with a toner container according to one embodiment.
Figure 4:
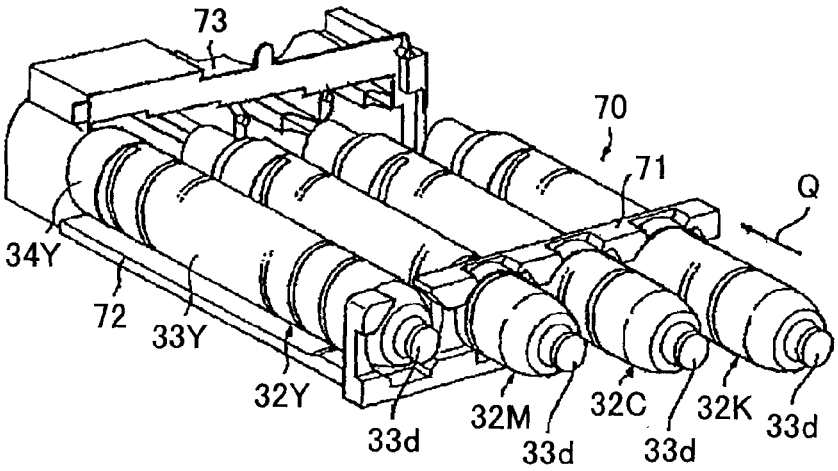
FIG. 4 is a schematic perspective view which illustrates a state such that a toner container housing unit of the image forming apparatus according to one embodiment is provided with the toner container.

Next, with reference to FIGS. 3 and 4, the toner replenishing apparatuses 60Y, 60M, 60C, and 60K are described in detail.

The toner within the respective toner containers 32Y, 32M, 32C, and 32K which are installed in the toner container housing unit 70 of the present image forming apparatus 100 is replenished into the respective developing apparatuses as needed by the toner replenishing apparatuses 60Y, 60K, 60C, and 60K which are provided for the respective toner colors depending on toner consumption within the developing apparatuses of the respective colors. The four toner replenishing apparatuses 60Y, 60M, 60C, 60K and the toner containers 32Y, 32M, 32C, and 32K have the same structure other than colors of the toners used in the image creating processes being different; therefore, only the toner replenishing apparatus 60Y and the toner container 32Y which correspond to yellow are explained, so that explanations of the toner replenishing apparatuses 60M, 60C, 60K, and the toner containers 32M, 32C, and 32K which correspond to the other three colors will be omitted as needed.

When the toner containers 32Y, 32M, 32C, and 32K move in an arrow Q direction in FIG. 4 to be mounted in the toner container housing unit 70 of the image forming apparatus 100, a shutter 38 of each of the toner containers 32Y, 32M, 32C, and 32K moves to cause a toner discharging hole W to be opened and cause the toner discharging hole W and a toner replenishing inlet 73*w* of the toner replenishing apparatuses 60Y, 60M, 60C, and 60K to be communicably connected. In this way, the toner contained within the toner container 32Y is discharged from the toner discharging hole W, so that it is pooled in a toner tank 61Y from the toner replenishing inlet 73*w* of the toner replenishing apparatus 60Y.

Figure 5A:
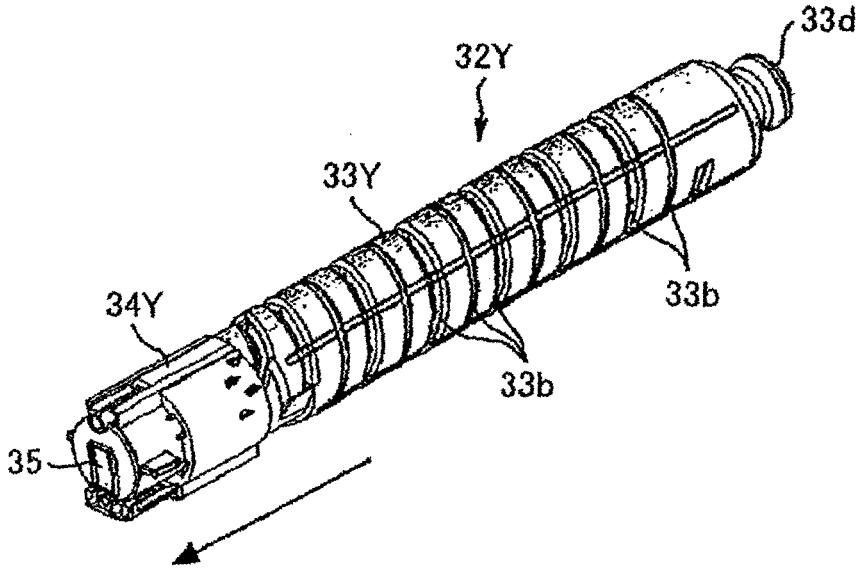
FIG. 5A is a perspective view which illustrates the toner container from an oblique top direction according to one embodiment.
Figure 6A:
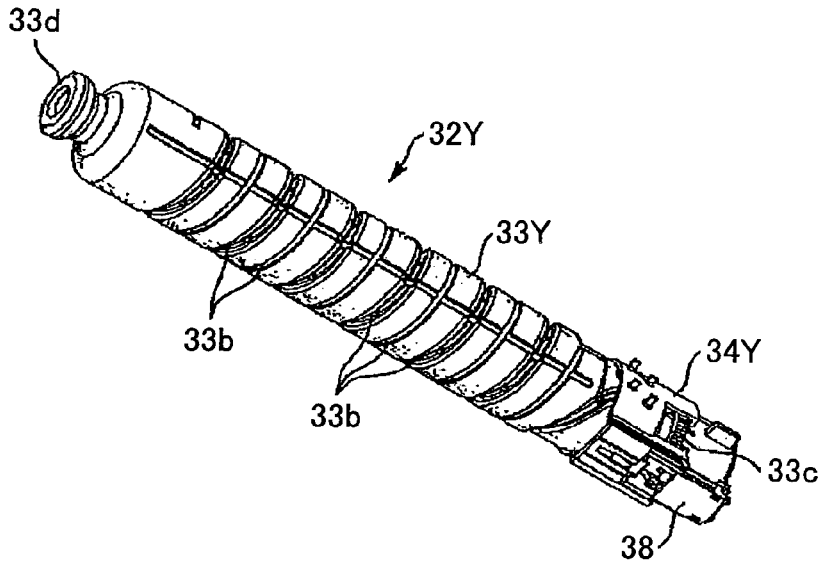
FIG. 6A is a perspective view which illustrates the toner container from an oblique bottom direction according to one embodiment.

The toner container 32Y of the present embodiment, which is a generally-cylindrical toner bottle, mainly includes a cap 34Y, which is non-rotatably held to the toner container housing unit 70; and a container body 33Y, which is integrally formed with a gear 33*c* (see FIG. 6A). The container body 33Y, which is held such that it can be rotated relative to the cap 34Y, is rotationally driven in an arrowed direction in FIG. 3 by a drive unit 91 (includes a drive motor, a drive gear, etc.). Then, the container body 33Y itself rotates, so that the toner contained inside the container body 33Y is conveyed from the left to the right in FIG. 3 along the longitudinal direction of the container body due to a projection 33*b* (see FIG. 5A) which is spirally formed on an inner peripheral face of the container body 33Y, causing the toner to be discharged from the toner discharging hole W of the cap 34Y. In other words, the container body 33Y of the toner container 32Y is rotationally driven in an appropriate manner by the drive unit 91, so that the toner is appropriately supplied to the toner tank 61Y. The toner containers 32Y, 32M, 32C, and 32K are replaced by new ones when they reach the service lifetime (when almost all the toner contained therein is consumed, causing the toner containers to be empty.).

The toner replenishing apparatus 60Y includes the toner container housing unit 70, the toner tank 61Y, a toner conveying screw 62Y, an agitating member 65Y, a toner end sensor 66Y, the drive unit 91, etc.

In the toner tank 61Y, which is arranged at a lower portion of the toner discharging hole W of the toner container 32Y, toner is pooled which is discharged from the toner discharging hole W of the toner container 32Y. A bottom portion of the toner tank 61Y is connected to an upstream portion of the toner conveying screw 62Y. Moreover, on a wall face of the toner tank 61Y is provided the toner end sensor 66Y, which detects when the toner pooled in the toner tank 61Y has reached an amount which is equal to or below a predetermined amount. As the toner end sensor 66Y, a piezoelectric sensor, etc., may be used. Then, when it is detected at a controller 90 by the toner end sensor 66Y that the toner pooled in the toner tank 61Y has reached an amount which is equal to or below a predetermined amount (when a toner end detection is made), the container body 33Y of the toner container 32Y is rotationally driven for a predetermined time period by the drive unit 91 (drive gear) with a control of the controller 90, so that the toner tank 61Y is replenished with the toner. Moreover, if the toner end detection by the toner end sensor 66Y is not released even when such a control is repeated, it is determined that there is no toner within the toner container 32Y, so that a display to urge a replacement of the toner container 32Y is made on a display unit (not shown) of the present image forming apparatus 100.

Moreover, the agitating member 65Y, which prevents the toner pooled in the toner tank 61Y from cohering, is provided in the vicinity of the toner end sensor 66Y in the toner tank 61Y. The agitating member 65Y, which has a flexible member provided on an axial section, agitates the toner within the toner tank 61Y by rotating in a clockwise direction in FIG. 3, Moreover, a tip of the flexible member of the agitating member 65Y slidingly contacts a detecting face of the toner end sensor 66Y with a rotational period thereof to prevent a failure such that the toner adheres to the detecting face of the toner end sensor, leading to decreased detecting accuracy.

While illustrations are omitted, the toner conveying screw 62Y conveys, in a direction toward an oblique top, the toner pooled in the toner tank 61Y. More specifically, the toner conveying screw 62Y linearly conveys the toner from a bottom portion (a nadir) of the toner tank 61Y to an upper portion of the developing apparatus 5Y. Then, the toner conveyed by the toner conveying screw 62Y free falls through the toner dropping and conveying path 64Y, so that it is replenished into the developing apparatus 5Y (the developing agent container 54Y).

Moreover, the toner container housing unit 70 mainly includes a cap receiving unit 73 for holding the cap 34Y of the toner container 32Y, a bottle receiving unit 72 (a container body receiving unit) for holding the container body 33Y of the toner container 32Y, and an inserting inlet 71 which serves as an inserting inlet at the time of operation of mounting the toner container 32Y. When a body cover (not shown) provided on the near side of the present image forming apparatus (on the near side in the vertical direction of the sheet in FIG. 1), the inserting inlet 71 of the toner container housing unit 70 is exposed. Then, with the longitudinal direction of the toner containers 32Y, 32M, 32C, and 32K as the horizontal direction, an operation of mounting and detaching the toner containers 32Y, 32M, 32C, and 32K from the nearer side of the present image forming apparatus 100 (an operation of mounting and detaching with the longitudinal direction of the toner container as a direction of mounting and detaching) is conducted. The bottle receiving unit 72 is formed such that the length in the longitudinal direction is almost equal to the length in the longitudinal direction of the container body 33Y. Moreover, the cap receiving unit 73 is provided on one end side in the longitudinal direction (mounting direction) in the bottle receiving unit 72, while the inserting inlet 71 is provided on the other end side in the longitudinal direction (mounting direction) of the bottle receiving unit 72. Therefore, with the mounting operation of the toner container 32Y, after passing through the inserting inlet 71, the cap 34Y slides on the bottle receiving unit 72 for a while, and then is set into the cap receiving unit 73.

Moreover, in the present embodiment, an RFID antenna is provided on the cap receiving unit 73 of the toner container housing unit 70 in which the toner container 32Y, 32M, 32C, and 32K are installed together such that they may be freely mounted and detached. As shown in FIG. 5A, this antenna is for communicating with an RFID chip 35 as an electronic information storage member which is provided on an end face of the cap 34Y of the toner container 32Y. Then, necessary information is delivered and received between the RFID chips 35 (an electronic information storage member) of the toner containers 32Y, 32M, 32C, 32K and the RFID antenna of the present image forming apparatus 100. Information mutually communicated includes information such as the number of recycles and a production number of the toner containers, etc.; information such as a color, a lot number, a toner volume, etc.; and information on history of using the present image forming apparatus 100. In the RFID chip 35, such electronic information sets are stored in advance before the toner container is installed in the present image forming apparatus 100. Moreover, information received after it is installed from the present image forming apparatus 100 is stored.

Figure 7:
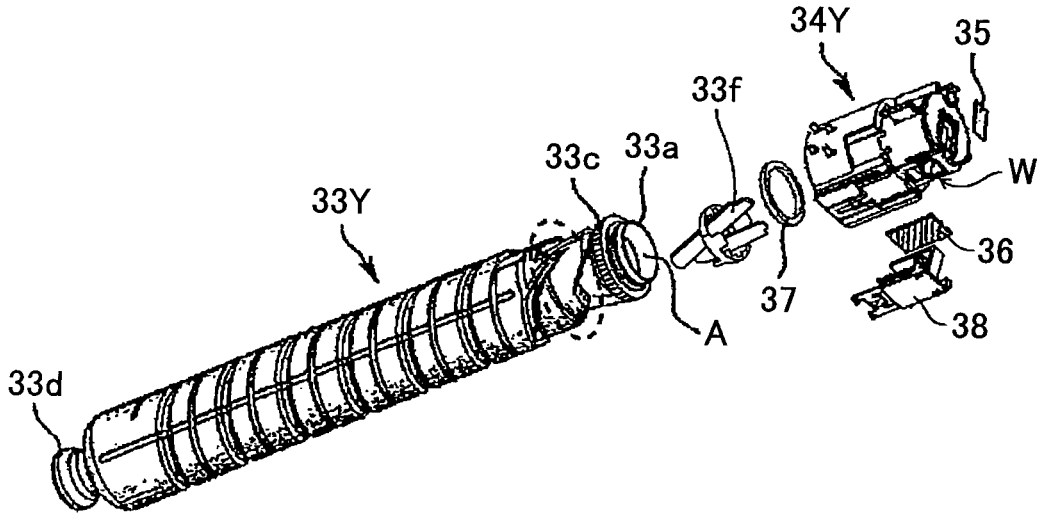
FIG. 7 is an exploded perspective view of the toner container according to one embodiment.

Next, with reference to FIGS. 5A, 6A, and 7, the toner containers 32Y, 32M, 32C, and 32K are described in detail.

The toner container 32Y of the present embodiment mainly includes the container body 33Y and the cap 34Y provided at the head portion thereof. Moreover, as shown in FIG. 7, the toner container 32Y is provided with an agitating member 33*f*, a cap seal 37, the shutter 38, a shutter seal 36, the RFID chip 35, etc.

The container body 33Y is provided with an opening A on one end side of the longitudinal direction of the container body 33Y. Moreover, the gear 33*c* which rotates integrally with the container body 33Y is provided on the end portion (the head portion) on the side in which the opening A of the container body 33Y is provided. The head portion of the container body 33Y becomes the head side in the operation of mounting when the toner container 32Y is mounted in the image forming apparatus body. The toner contained in the container body 33Y is discharged from the opening A to the space (temporary containing space) within the cap 34Y. Conveying of the toner from the container body 33Y to the cap 34Y (rotational driving of the container body 33Y) is conducted as needed, such that the toner within the cap 34Y does not fall below a predetermined level.

The gear 33*c* is for rotationally driving the container body 33Y with the longitudinal direction of the container body 33Y as a rotational axis, meshing with a drive gear provided with the toner container housing unit 70 of the image forming apparatus 100. More specifically, the gear 33*c*, which is formed such that it makes a round of the opening A, has multiple teeth formed radially, or orthogonal to the rotational axis of the container body 33Y. Then, the gear 33*c* meshes with the drive gear of the present image forming apparatus 100 with a part thereof being exposed from a notch formed in the cap 34Y as shown in FIG. 6. Then, a driving force is transmitted from the drive gear to the gear 33*c*, causing the container body 33Y to rotate. In the present embodiment, the drive gear and the gear 33*c* are spur gears.

As shown in FIGS. 5A and 6A, at the end portion on the opposite side of the opening A of the container body 33Y (on the back end side in the mounting direction) is provided a grip 33*d* for a user to grip when performing an operation of mounting and detaching the toner container 32Y. While gripping the grip 33*d*, the user mounts the toner container 32Y in the present image forming apparatus 100 (moving of the toner container 32Y in the arrow direction of FIG. 5A).

On an inner peripheral face of the container body 33Y is provided a spirally-shaped projection 33*b* (which is a spiral-shaped groove when viewed from the outer peripheral face side). The spiral-shaped projection 33*b* is for rotationally driving the container body 33Y in a predetermined direction to discharge toner from the opening A. The thus configured container body 33Y may be manufactured by blow molding together with the grip 33*d* and the gear 33*c* arranged on the peripheral face thereof.

Moreover, in the toner container 32Y of the present embodiment, the agitating member 33*f* which rotates with the container body 33Y is fitted into a bottle inlet 33*a* (opening A), as shown in FIG. 7. The agitating member 33*f*, which is a bar-shaped member which projects into a cavity within the cap 34Y, has a function of agitating toner within the cavity of the cap 34Y.

Moreover, the bottle inlet 33*a* of the container body 33Y is fitted into the cap 34Y such that it can rotate relative to the cap 34Y. Therefore, the gear 33*c* rotates relative to the cap 34Y. Moreover, an inner diameter of a head portion (in the vicinity of a location at which the gear 33*c* is formed) of the container body 33Y is formed such that it is smaller than an inner diameter of a part of the container body 33Y (a location at which the spiral-shaped projection 33*b* is formed) in which part the toner is contained. Then, at the head portion of the container body 33Y is provided a pumping portion (a portion surrounded by a broken line in FIG. 7) which is formed such that an inner peripheral face thereof protrudes into the inside. Then, the toner which is conveyed toward the opening A due to the spiral-shaped projection 33*b* along with rotating of the container body 33Y is pumped to a small diameter portion of the head portion by the pumping portion. Then, the toner which is pumped to the small diameter portion of the head portion is discharged toward a cavity of the cap 34Y from the opening A while it is agitated by the agitating member 33*f*.

The cap 34Y has an inserting portion formed such that it has an inner diameter larger than the cavity, into which inserting portion the opening A of the container body 33Y is inserted. At a bottom portion of the cap 34Y (a portion located at an lower portion thereof when it is mounted in the image forming apparatus body) is formed the toner discharging hole W for discharging the toner, which is discharged from the opening A of the container body 33Y, out of the container 32Y and downward in a vertical direction (causing the toner to free fall). Then, at the bottom portion of the cap 34Y is held the shutter 38 for opening and closing the toner discharging hole W such that it can slide in the longitudinal direction of the container body 33Y (in the direction of the rotational axis of the container body 33Y). This shutter 38 slides in a direction from the head portion side of the container body to the grip 33*d* side of the container body 33Y to open the toner discharging hole W, and, conversely, slides in a direction from the grip 33*d* side of the container body 33Y to the head portion side of the container body 33Y to block the toner discharging hole W. An operation of opening and closing the shutter 38 (an operation of opening and closing the toner discharging hole W) is performed in cooperation with an operation of mounting in and detaching from the toner container housing unit 70 of the present image forming apparatus the toner container 32Y in the longitudinal direction.

Figure 8A:
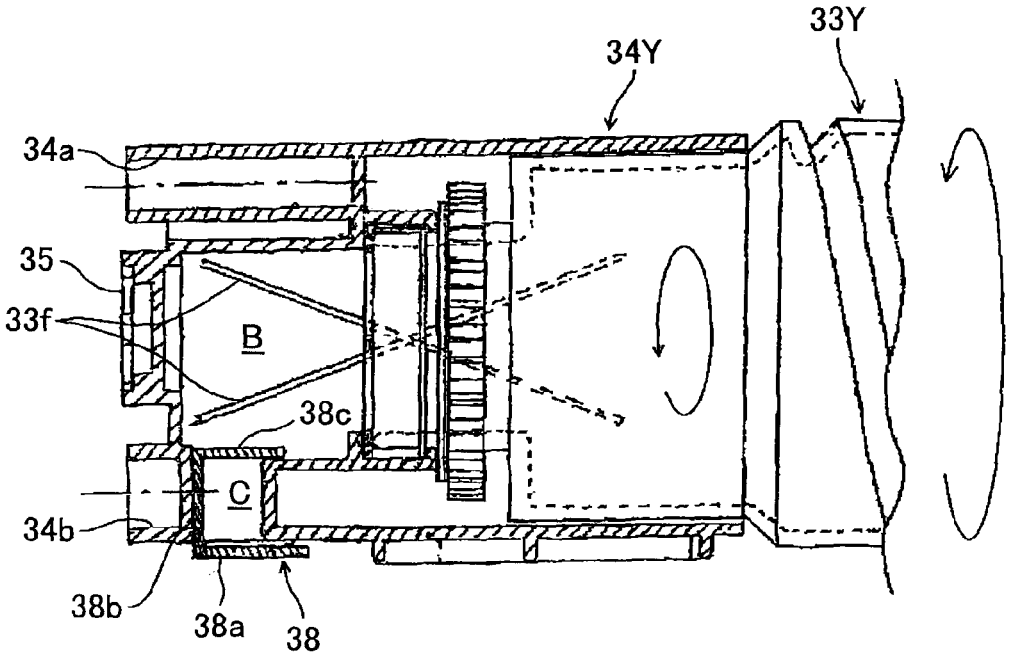
FIG. 8A is a partial cross-sectional diagram when a cap of the toner container according to one embodiment that is not mounted in an image forming apparatus body is partially cut along a longitudinal direction of a container body.

FIG. 8A is a partial cross-sectional diagram when the cap 34Y of the toner container 32Y that is not mounted in the image forming apparatus body is partially cut in the longitudinal direction of the container body 33Y.

Figure 9A:
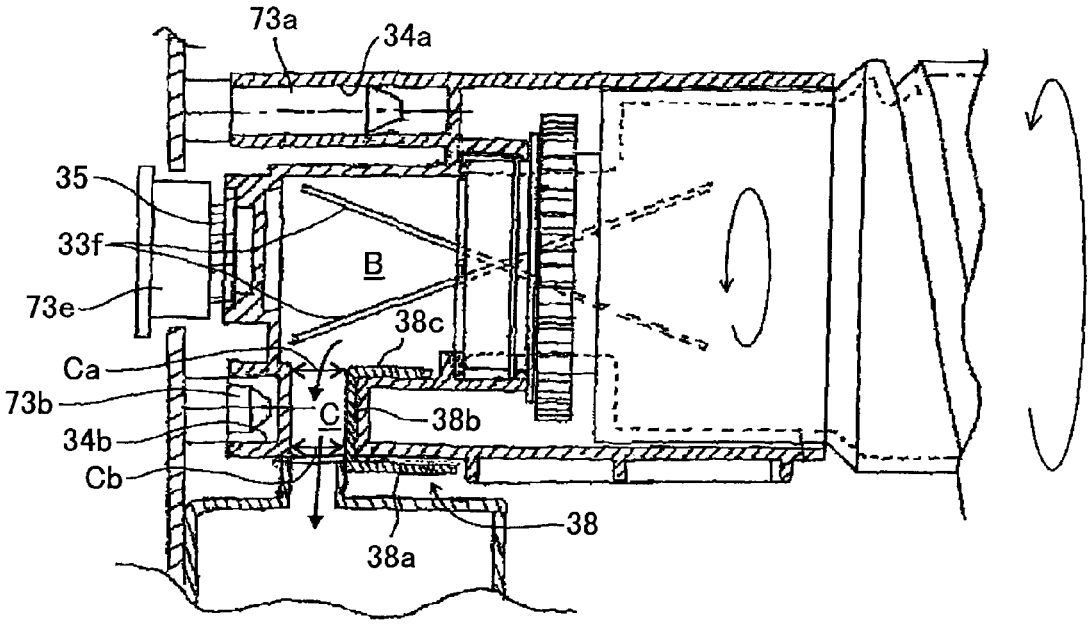
FIG. 9A is a partial cross-sectional diagram when the cap of the toner container according to one embodiment that is mounted in the image forming apparatus body is partially cut along the longitudinal direction of the container body.

FIG. 9A is a partial cross-sectional diagram when the cap 34Y of the toner container 32Y that is mounted to the image forming apparatus body is partially cut in the longitudinal direction of the container body.

At an upper portion (a ceiling portion) of the cap 34Y is formed a first hole 34*a* which is projected in the longitudinal direction from an end face of the cap 34Y on which the RFID chip 35 is provided. The first hole 34*a* becomes a main reference for positioning the cap 34Y according to the present image forming apparatus 100. More specifically, a main reference pin 73*a* of the cap receiving unit 73 is inserted into the first hole 34*a* of the cap 34Y, so that it engages the first hole 34*a* in cooperation of the operation of mounting in the longitudinal direction of the toner container 32Y in the toner container housing unit 70.

Moreover, at a lower portion (a bottom portion) of the cap 34Y is formed a second hole 34*b* which is projected in the longitudinal direction from an end face of the cap 34Y on which the RFID chip 35 is provided, which second hole 34*b* is formed such that it does not reach the toner discharging hole W. The second hole 34*b* becomes a sub reference for positioning the cap 34Y according to the present image forming apparatus 100. More specifically, a sub reference pin 73*b* of the cap receiving unit 73 is inserted into the second hole 34*b* of the cap 34Y, so that it engages the second hole 34*b* in cooperation with the operation of mounting in the longitudinal direction of the toner container 32Y in the toner container housing unit 70.

With the thus configured two holes 34*a* and 36*b*, positioning of the cap 34Y in the toner container housing unit 70 is performed.

Here, a hole depth of the first hole 34*a* (or a length of the main reference pin 73*a* in the longitudinal direction) is set longer than a hole depth of the second hole 34*b* (or a length of the sub reference pin 73*b* in the longitudinal direction). In this way, in the operation of mounting in the longitudinal direction of the toner container 32Y in the toner container housing unit 70, engaging of the main reference pin 73*a* into the first hole 34*a* to be the main positioning reference is started, after which engaging of the sub reference pin 73*b* into the second hole 34*b* to be the sub positioning reference is started, making it possible to smoothly mount the toner container 32Y in the toner container housing unit 70. Moreover, the first hole 34*a*, which is elongated in the longitudinal direction, is provided at the ceiling portion (a portion which is never buried in toner) of the cap 34Y, so that no impact occurs on toner conveyance (mobility) within the cap 34Y. Moreover, the second hole 34*b*, which is short in the longitudinal direction, is provided at the bottom portion of the cap 34Y; however, it may be provided by using a small space from the end face of the cap 34Y to a location of the toner discharging hole W, so that a function of the sub positioning criteria is sufficiently demonstrated.

On an end face of the cap 34Y is provided between the first hole 34*a* and the second hole 34*b* the RFID chip 35 in which various electronic information sets are stored. The RFID chip 35 is configured such that it opposes an antenna 73*e* of the cap receiving unit 73 at a predetermined distance with the cap 34Y being mounted in the toner container housing unit 70. Then, the RFID chip 35 conducts non-contact communication (wireless communication) with the antenna 73*e* with the cap 34Y being held to the cap receiving unit 73.

Here, in the present embodiment, as the RFID chip 35 is securely installed between the first hole 34*a* (main reference) and the second hole 34*b* (sub reference), a position of the RFID chip 35 relative to the antenna 73*e* of the cap receiving unit 73 is accurately determined. Therefore, a communications failure due to an offset of the RFID chip 35 relative to the antenna 73*e* (the RFID antenna) may be prevented.

Now, when the toner container 32Y of the present embodiment is left for a certain time period in a relatively high temperature environment (warehouse, etc.) with the cap 34Y facing down and the toner being contained inside, the toner within the cap 34 is compressed by the weight of the toner within the container body 32Y, such that it coheres. In this case, when mounting the toner container 32Y in the image forming apparatus body to use the toner container 32Y, a failure occurs of discharging toner to the image forming apparatus body from the toner discharging hole W provided in the cap 34Y. In the present embodiment, the toner container 32Y is mounted in the image forming apparatus body, after which the container body 33Y is rotationally driven, so that the agitating member 33*f* is rotationally driven, thereby agitating the toner in the cavity (the temporary containing space) of the cap 34Y to disentangle the toner. Therefore, cohering of the toner within the cavity of the cap 34Y may be prevented. However, the agitating member 33*f* does not reach an inner space C of the toner discharging hole W that is projected from the cavity B to the bottom portion, or a space C between an inlet face Ca of the toner discharging hole W which faces an inner wall face of the cap 34Y and an outlet face Cb of the toner discharging hole W which faces an outer wall face of the cap 34Y. Therefore, the toner which coheres within the inner space C of the toner discharging hole W continues to cohere even after the toner container 32Y is mounted in the image forming apparatus body to rotationally drive the container body 33Y. If such cohered toner is left blocking the toner discharging hole W, a failure occurs of discharging toner from the toner discharging hole W to the image forming apparatus body, for which failure there is a need to improve.

Figure 10:
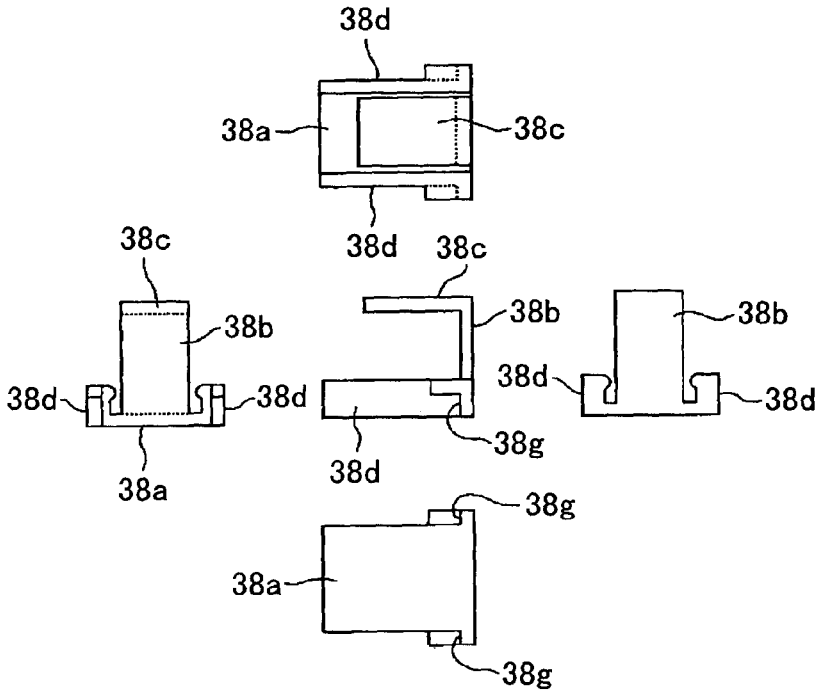
FIG. 10 is a six-face view of a shutter provided in the cap according to one embodiment, with a back view thereof omitted.

FIG. 10 is a six-face view of the shutter 38 according to the present embodiment, with a back view omitted.

Figure 11:
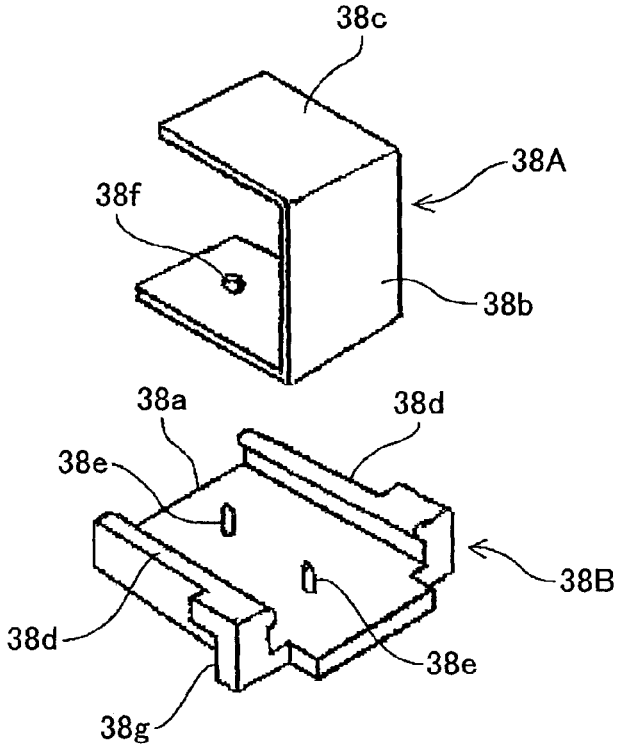
FIG. 11 is an exploded perspective view of the shutter according to one embodiment.

FIG. 11 is an exploded perspective view of the shutter 38 according to the present embodiment.

In the present embodiment, the shutter 38 is provided with a blocking member for blocking toner within the cavity B of the cap 34Y from passing through the inlet face Ca of the toner discharging hole W facing the cavity B. The blocking member of the present embodiment includes a rising portion 38*b* which extends to the inlet face Ca of the toner discharging hole W from an inner wall face of a shutter substrate 38*a* as a shutter member for blocking the outlet face Cb of the toner discharging hole W facing an outer wall face of the cap 34Y; and a visor 38*c* as a blocking portion which is fixed to a tip of the rising portion 38*b* so as to make it possible to block the inlet face Ca of the toner discharging hole W. As shown in FIG. 11, the shutter 38 is formed by fitting a projecting portion 38*e* formed on a substrate 38B which includes the shutter substrate 38*a* into a positioning hole 38*f* provided at a bottom face portion (a portion opposing the visor 38*c*) of a U-shaped member 38A which includes the rising portion 38*b* and the visor 38*c*.

Figure 12:
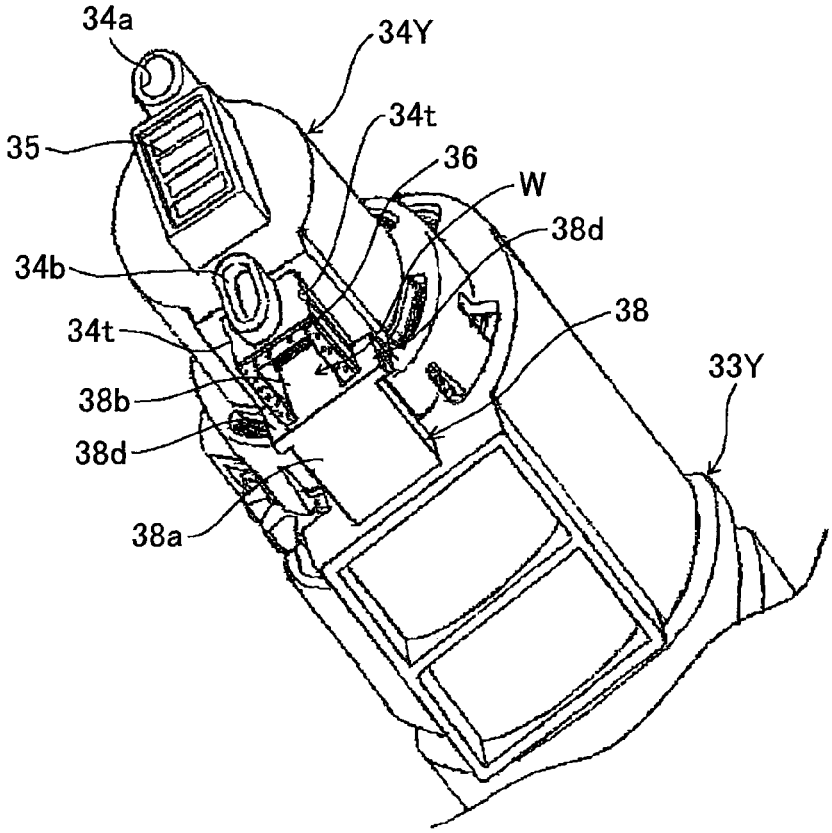
FIG. 12 is a perspective view of the cap from the bottom when the shutter according to one embodiment is at an open position.

FIG. 12 is a perspective view of the cap 34Y from the bottom when the shutter 38 is at an open position.

At the bottom portion of the cap 34Y is formed on both sides thereof a sliding groove 34*t* for guiding and moving in the longitudinal direction the shutter 38 such that the shutter 38 opens and closes the toner discharging hole W. This sliding groove 34*t* is a groove which slidably engages a pair of rails 38*d* that is formed one rail on each side in the sliding movement direction of the shutter substrate 38*a* of the shutter 38. Then, the rails of the pair of rails 38*d* and the sliding groove 34*t* engage such that the sliding groove 34*t* of the cap 34Y is put between the rails of the pair of rails 38*d* in the shutter 38, making it possible for the shutter 38 to slide along the sliding groove 34*t* along the longitudinal direction.

At the bottom portion of the cap 34Y is pasted a shutter seal 36 to an edge of the outlet face Cb of the toner discharging hole W. This shutter seal 36, which is for preventing toner from leaking from between the outlet face Cb of the toner discharging hole W and the shutter substrate 38*a* when the shutter substrate 38*a* of the shutter 38 is positioned at a closed position at which the outlet face Cb of the toner discharging hole W is blocked, may be formed with a foam resin material, etc.

Figure 13:
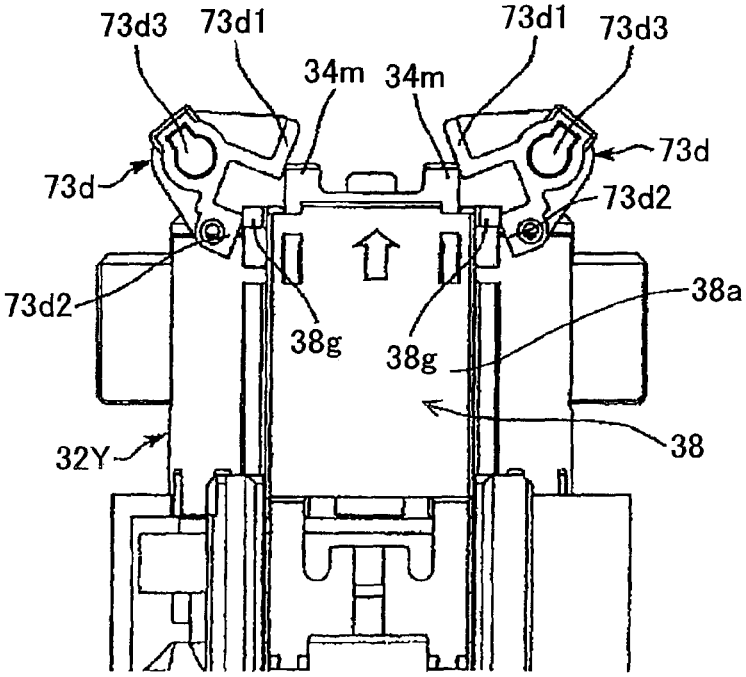
FIG. 13 is an explanatory diagram illustrating a state in which a toner discharging outlet is opened while the shutter of the toner container engages a shutter closing mechanism of a toner container housing unit.
Figure 14:
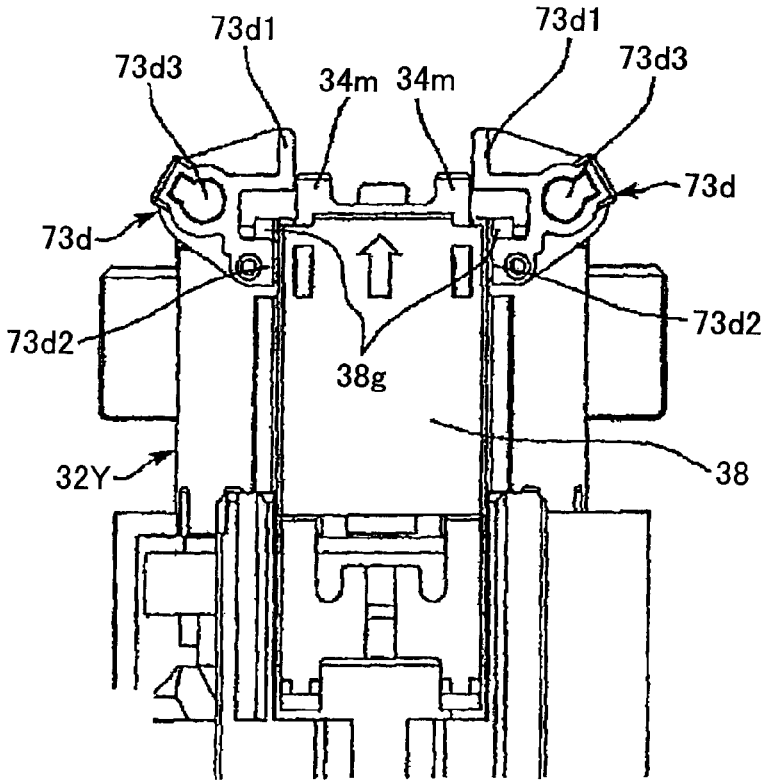
FIG. 14 is an explanatory diagram which continues from FIG. 13.
Figure 15:
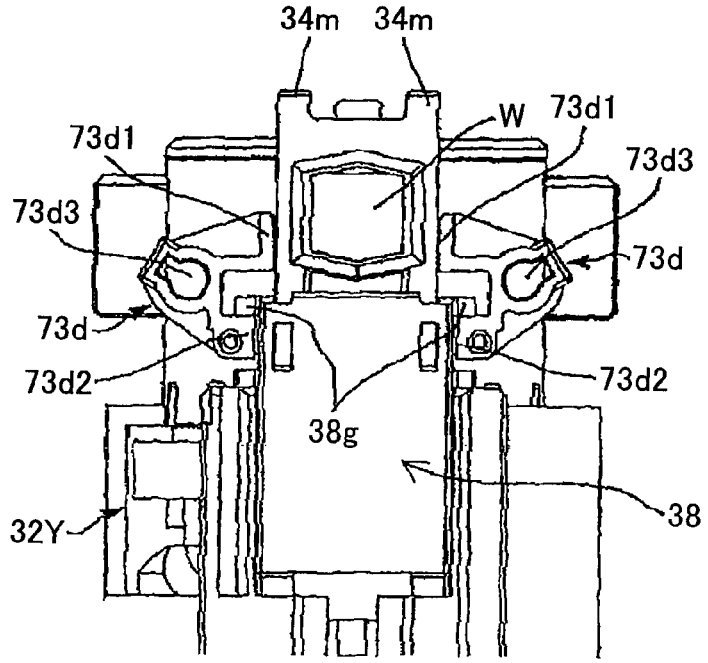
FIG. 15 is an explanatory diagram which continues from FIG. 14.

FIGS. 13-15 are diagrams illustrating operations of a shutter closing mechanism 73*d* in conjunction with opening and closing operations of the shutter 38.

First, as shown in FIG. 13, at the time of the operation of opening the shutter 38, a first holding member 73*d*1 which is provided at the cap receiving unit 73 in the toner container housing unit 70 of the image forming apparatus body touches a projection 34*m* of the cap 34Y in conjunction with the operation of mounting the toner container 32Y in the direction of a white arrow. Then, as shown in FIG. 14, as the operation of mounting of the toner container 32Y in the white arrow direction proceeds, the first holding member 73*d*1 is pushed by the projection 34*m* of the cap 34Y, so that the shutter closing mechanism 73*d* rotates around the spindle 73*d*3 and a second holding member 73*d*2 holds the shutter substrate 38*a* of the shutter 38. Thereafter, as the shutter 38 touches the wall portion formed in the periphery of the toner replenishing inlet 73*w* of the cap receiving unit 73, it is held between the wall portion and the second holding member 73*d*2, so that movement of the shutter 38 is regulated and the shutter 38 never moves in the longitudinal direction. On the other hand, as a movement of the toner container 32Y in the mounting direction proceeds, the shutter 38 moves in the opening direction relative to the cap 34Y. In other words, as shown in FIG. 15, the shutter 38 relatively moves to the side of the container body 33Y to open the toner discharging hole W.

On the other hand, when the toner container 32Y is removed from the toner container housing unit 70, an operation is performed according to procedures which are reverse to the above-described procedure at the time of mounting. More specifically, at the time of operation of blocking the shutter 38, when an operation is performed of removing the toner container 32Y in a direction which is reverse to the white arrow direction, as shown in FIG. 15, the second holding member 73*d*2 of the cap receiving unit 73 that holds the shutter substrate 38*a* of the shutter 38 gets caught on the projection 38*g* which is formed on a side portion of the shutter substrate 38*a* of the shutter 38. Now, the first holding member 73*d*1 of the cap receiving unit 73 touches the side face of the projection 34*m* of the cap 34Y, so that the shutter closing mechanism 73*d* never rotates around the spindle 73*d*3. Then, the shutter 38 proceeds to move in the direction of removal of the toner container 32Y, while being regulated from moving in the direction of removal. In this way, the shutter 38 moves in the blocking direction relative to the cap 34Y, blocking the toner discharging hole W as shown in FIG. 14. Then, when the toner discharging hole W is blocked, touching between the first holding member 73*d*1 of the cap receiving unit 73 and the side face of the projection 34*m* of the cap 34Y is released, making it possible for the shutter closing mechanism 73*d* to rotate around the spindle 73*d*3. Thus, further performing the operation of removing the toner container 32Y causes the projection 38*g* of the shutter 38 to push the second holding member 73*d*2, causing the shutter closing mechanism 73*d* to rotate around the spindle 73*d*3, as shown in FIG. 13. As a result, the projection 38*g* of the shutter 38 never gets caught on the second holding member 73*d*2, making it possible to remove the toner container 32Y.

As described above, the image forming apparatus 100 according to the present embodiment has the toner containers 32Y, 32M, 32C, and 32K (Y, M, C, and K, which are color identifying letters, will be omitted below) detachably mounted thereto, the toner containers being powder material containers which contain toner, which is a powder material used at the time of image creation operations. The toner container 32 includes the elongated tubular container body 33 which has formed the opening A on one end side in the longitudinal direction and which is configured such that the toner contained therein is conveyed toward the opening A; and the cap 34 which has the cavity B formed therein, which cavity B is a temporary containing space which is communicably connected in the longitudinal direction of the container body to the opening A of the container body 33 to temporarily contain toner conveyed from the opening A and which has the toner discharging hole W formed on a side face (a face to be a bottom face at the time of mounting to the image forming apparatus body) relative to the longitudinal direction of the container body, the toner discharging hole W being a discharging hole which discharges toner within the cavity B to outside. Then, it has the blocking members 38*b* and 38*c* which allow switching between a blocking state as shown in FIG. 8A that blocks toner within the cavity B from passing through the inlet face Ca of the toner discharging hole W and a non-blocking state as shown in FIG. 9A that does not block toner within the cavity from passing through the inlet face Ca of the toner discharging hole W. In this way, even when the present toner container 32 has been left for a certain period in a relatively high temperature environment (warehouse, etc.) with the toner contained inside and the cap 34 positioned such that it faces downward, the toner does not get into the inner space C of the toner discharging hole W due to the blocking members 38*b* and 38*c*, making it possible to prevent, from cohering, the toner within the internal space C of the toner discharging hole W that cannot be disentangled even when the agitating member 33*f* is used. Thus, a toner discharging failure due to toner cohesion within the inner space C of the toner discharging hole W may be prevented.

Moreover, the present embodiment is provided with the shutter substrate 38*a*, which is a shutter member which is movable between an open position at which is opened the outlet face Cb of the toner discharging hole W which faces an outer wall face of the cap 34 and a closing position at which is blocked the outlet face Cb of the toner discharging hole W and which is configured such that the blocking members 38*b* and 38*c* are not blocked when the shutter substrate 38*a* is at the open position and the blocking members 38*b* and 38*c* are blocked when the shutter substrate 38*a* is at the closed position. Such a configuration makes it possible to use an opening and closing operating mechanism for a related-art common shutter substrate 38*a* to switch between the open and closed states of the blocking members 38*b* and 38*c*.

More specifically, the present embodiment is configured such that the blocking members 38*b* and 38*c* switch from a non-blocking state to a blocking state in cooperation with movement of the shutter substrate 38*a* from the open state to the closed state and the blocking members 38*b* and 38*c* switch from the blocking state to the non-blocking state in cooperation with movement of the shutter substrate 38*a* from the closing state to the open state. In this way, a configuration in which the blocking members 38*b* and 38*c* cooperate with the shutter substrate 38*a* make it possible to switch between the blocking state and the non-blocking state of the blocking members 38*b* and 38*c* using the opening and closing operation mechanism of the related-art general shutter substrate 38*a*.

Moreover, the blocking member according to the present embodiment, which includes the rising portion 38*b* which extends to the inlet face Ca of the toner discharging hole W from the inner wall face of the shutter substrate 38*a* and the visor 38*c* as a blocking portion which is fixed to a tip of the rising portion 38*b* and which can block the inlet face Ca of the toner discharging hole W, is configured such that, in cooperation with movement of the shutter substrate 38*a* from the open position to the closed position, the visor 38*c* of the blocking member moves to a blocking position at which the inlet face Ca of the toner discharging hole W is blocked and that, in cooperation with movement of the shutter substrate 38*a* from the closed position to the open position, the visor 38*c* of the blocking member moves to a non-blocking position at which the inlet face Ca of the toner discharging hole W is not blocked. In this way, a configuration may be simply realized in which the blocking members 38*b* and 38*c* cooperate with the shutter substrate 38*a*.

Moreover, the present embodiment has the agitating member 33*f* which agitates toner within the cavity B in the cap 34. This makes it possible to tear down cohered toner within the cavity B in the cap 34, making it possible to realize smooth discharging of toner. More specifically, the present embodiment, which includes the gear 33*c* as a rotational driving unit which drives rotationally with a drive force received from outside, is configured such that the agitating member 33*f* is driven with rotationally driving of the gear 33*c* to agitate toner within the cavity B, making it possible to tear down firmly cohered toner with strong agitating force.

The present invention is not limited to the respective embodiments described above, which may be changed as needed from what are implied in the respective embodiments within the scope of the present invention. Moreover, the number, position, shape, etc., of the above-described constituting members are not limited to the respective embodiments, so that preferable number, position, shape, etc., may be adopted in implementing the present invention.

Next, another embodiment is described which embodies the invention proposed herein. This embodiment, which also represents the invention related to a toner container, and an image forming apparatus to which the toner container is mounted is the same as what is shown in FIGS. 1 to 4 in the previous embodiment, so that a repeated explanation will be omitted.

Figure 5B:
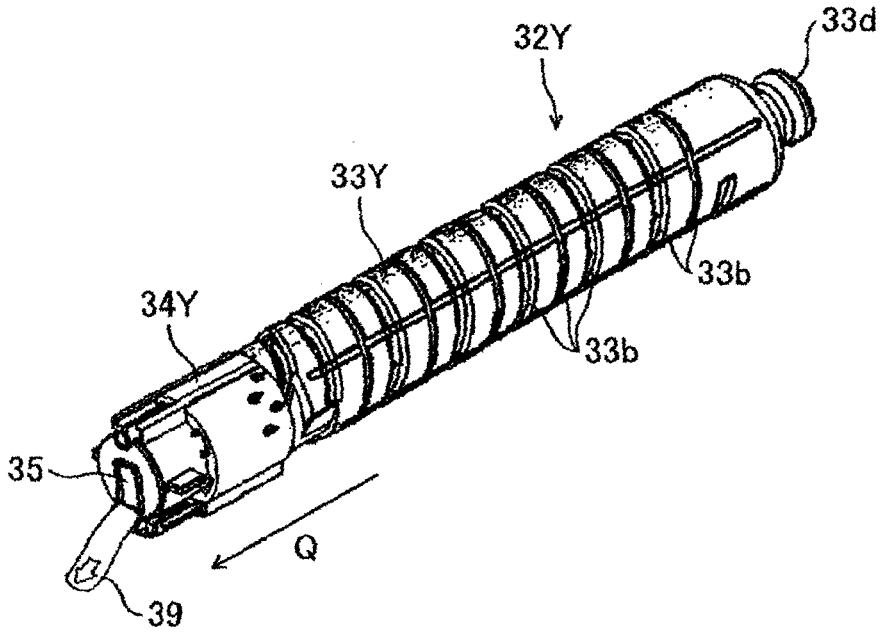
FIG. 5B is a perspective view which illustrates the toner container from the oblique top direction according to another embodiment.
Figure 6B:
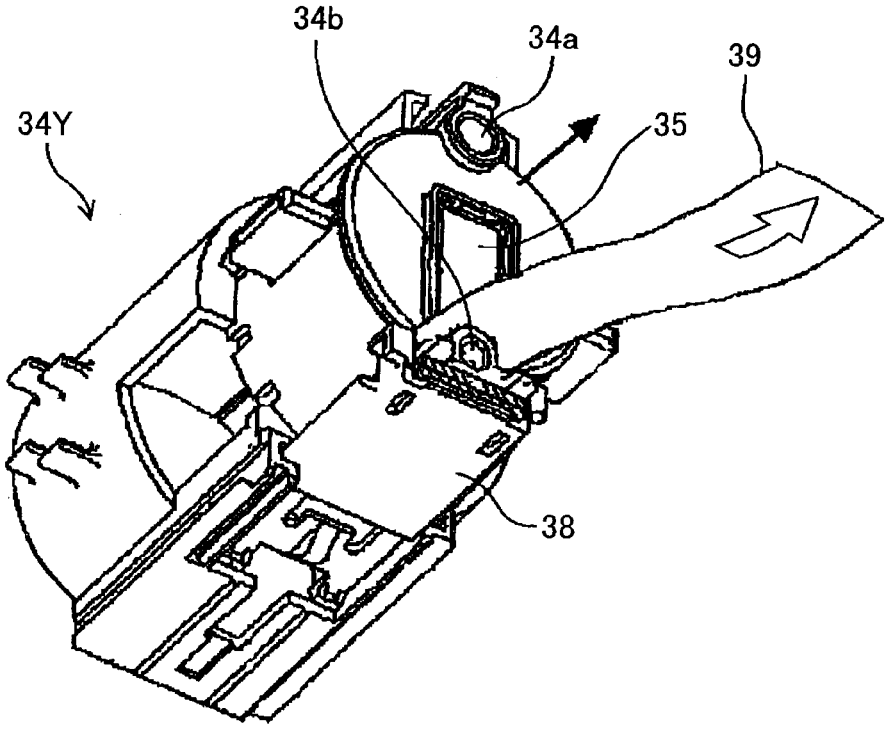
FIG. 6B is a perspective view which illustrates a cap of the toner container from the oblique bottom direction according to another embodiment.
Figure 8B:
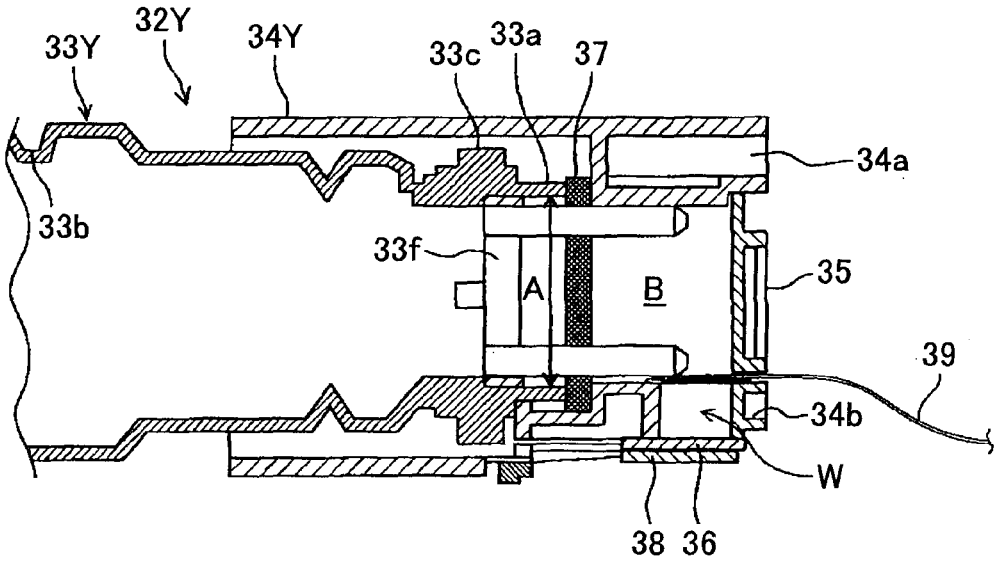
FIG. 8B is a partial cross-sectional diagram when the cap of the toner container according to another embodiment that is not mounted in the image forming apparatus body is partially cut along the longitudinal direction of the container body.

With reference to FIGS. 5B, 6B, and 8B, the toner containers 32Y, 32M, 32C, and 32K are described in detail.

The toner container 32Y of the present embodiment mainly includes the container body 33Y and the cap 34Y provided at the head portion thereof. Moreover, as shown in FIGS. 6B and 7B, the toner container 32Y is provided with the agitating member 33*f*; the cap seal 37; the shutter 38; the shutter seal 36; the RFID chip 35; a seal 39 as a sealing member, etc.

As shown in FIG. 8B, the container body 33Y is provided with an opening A on one end side of the longitudinal direction of the container itself. Moreover, a gear 33*c* which rotates integrally with the container body 33Y is provided on the end portion (the head portion) on the side in which an opening A of the container body 33Y is provided. The head portion of the container body 33Y becomes the head side in the operation of mounting when the toner container 32Y is mounted in the image forming apparatus body. The toner contained in the container body 33Y is discharged from the opening A to the cavity (temporary containing space) within the cap 34Y. Conveying of toner from the container body 33Y to the cap 34Y (a rotational drive of the container body 33Y) is appropriately conducted such that the toner within the cap 34Y does not fall below a predetermined level.

The gear 33*c* is for rotationally driving the container body 33Y with the longitudinal direction of the container body 33Y as an axis of rotation, meshing with a drive gear provided at the toner container housing unit 70 of the present image forming apparatus 100. More specifically, the gear 33*c*, which is formed such that it makes a round of the opening A, has multiple teeth formed radially to the axis of rotation of the container body 33Y. Then, the gear 33*c* meshes with the drive gear of the present image forming apparatus 100 with a part thereof being exposed from a notch formed in the cap 34Y. Then, a driving force is transmitted from the drive gear to the gear 33*c*, causing the container body 33Y to rotate. In the present embodiment, the drive gear and the gear 33*c* are spur gears.

As shown in FIG. 5B, at the end portion on the opposite side of the opening A of the container body 33Y (on the back end side in the mounting direction) is provided a grip 33*d* for a user to grip when performing an operation of mounting and detaching the toner container 32Y. While gripping the grip 33*d*, the user mounts the toner container 32Y in the present image forming apparatus 100 (movement of the toner container 32Y in the arrow direction Q of FIG. 5B).

On an inner peripheral face of the container body 33Y is provided a spiral-shaped projection 33*b* (which is a spiral-shaped groove when viewed from the outer peripheral face side). The spiral-shaped projection 33*b* is for rotationally driving the container body 33Y in a predetermined direction to discharge toner from the opening A. The thus configured container body 33Y may be manufactured by blow molding together with the grip 33*d* and the gear 33*c* arranged on the peripheral face thereof.

Moreover, in the toner container 32Y of the present embodiment, as shown in FIG. 8B, the agitating member 33*f* which rotates with the container body 33Y is fitted into a bottle inlet 33*a* (Opening A). The agitating member 33*f*, which is a bar-shaped member which is projected into a cavity within the cap 34Y, has a function of agitating toner within the cavity of the cap 34Y.

Moreover, the bottle inlet 33*a* of the container body 33Y is fitted into the cap 34Y such that it can rotate relative to the cap 34Y. Therefore, the gear 33*c* rotates relative to the cap 34Y. Moreover, an inner diameter of a head portion (in the vicinity of a location at which the gear 33*c* is formed) of the container main body 33Y is formed such that it is smaller than an inner diameter of a container (a location at which a spiral-shaped projection 33*b* is formed) in which the toner is contained. Then, at the head portion of the container body 33Y is provided a pumping portion which is formed such that an inner peripheral face thereof protrudes into the inside. Then, the toner which is conveyed toward the opening A due to the spiral-shaped projection 333*b* along with rotating of the container body 33Y is pumped to a small diameter portion of the head portion by the pumping portion. Then, the toner which is pumped to the small diameter portion of the head portion is discharged toward a cavity B of the cap 34Y from the opening A while it is agitated by the agitating member 33*f*.

The cap 34Y has an inserting portion formed such that it has an inner diameter larger than the cavity, into which inserting portion the opening A of the container body 33Y is inserted. At a bottom portion of the cap 34Y (a portion located at an lower portion thereof when it is mounted in the image forming apparatus body) is formed a toner discharging hole W for discharging the toner, which is discharged from the opening A of the container body 33Y, out of the container and downward in a vertical direction (causing the toner to free fall). Then, at the bottom portion of the cap 34Y is held a shutter 38 for opening and closing the toner discharging hole W such that it can slide in the longitudinal direction of the container body 33Y (in the direction of the rotational axis of the container body 33Y). This shutter 38 slides in a direction from the head portion side of the container body 33Y to the grip 33*d* side of the container body 33Y (from right to left in FIG. 8B) to open the toner discharging hole W, and, conversely, slides in a direction from the grip 33*d* side of the container body 33Y to the head portion side of the container body 33Y (from left to right in FIG. 8B) to block the toner discharging hole W. An operation of opening and closing the shutter 38 (an operation of opening and closing the toner discharging hole W) is performed in cooperation with an operation of mounting in and detaching from the toner container housing unit 70 of the present image forming apparatus 100 the toner container 32Y in the longitudinal direction.

Figure 9B:
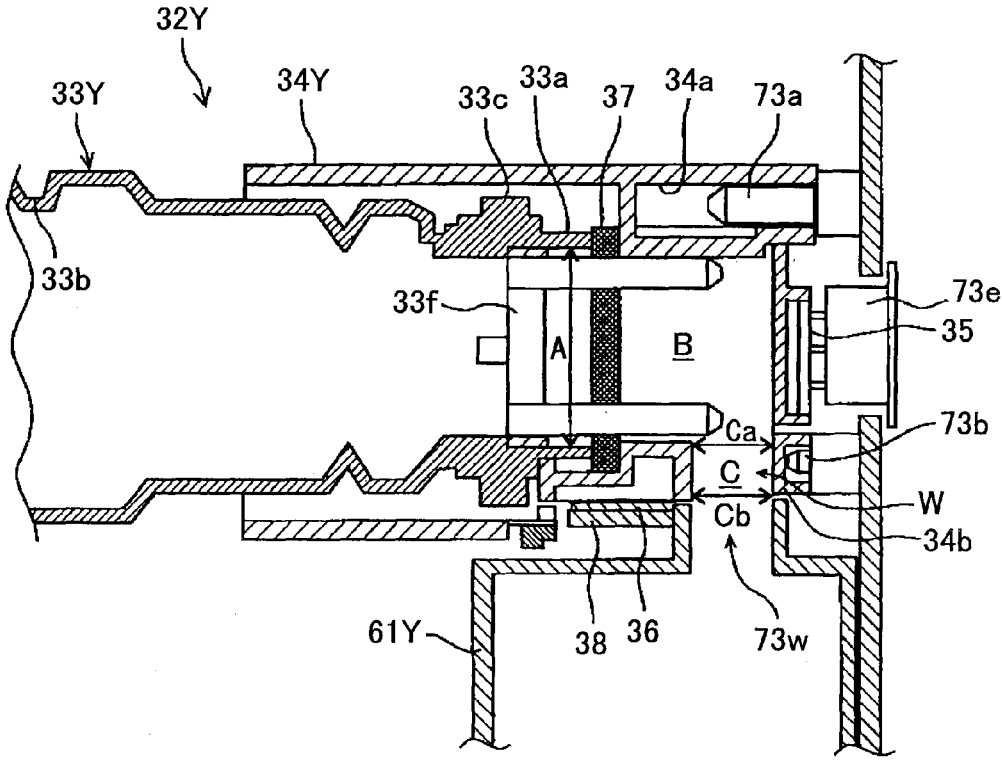
FIG. 9B is a partial cross-sectional diagram when the cap of the toner container according to another embodiment that is mounted in the image forming apparatus body is partially cut along the longitudinal direction of the container body.

FIG. 9B is a partial cross-sectional diagram when the cap 34Y of the toner container 32Y that is mounted in the image forming apparatus body is partially cut in the longitudinal direction of the container body 33Y.

Before the toner container 32Y of the present embodiment is mounted in the toner container housing unit 70 of the present image forming apparatus 100 to start using the toner container 32Y, a seal 39 which seals the inlet face Ca of the toner discharging hole W formed in the cap 34Y of the toner container 32Y is pulled out of the toner container 32Y. The seal 39, which is a strip-shaped sheet which includes elongated sheet-shaped members, is arranged such that it has one end in the longitudinal direction being exposed from the container body 33Y as shown in FIGS. 6B and 8B. As shown in FIG. 8B, a portion of the seal 39 that is positioned inside the cap 34Y is turned around in the middle in the longitudinal direction, and a face on the outer side of the turn on the other end side in the longitudinal direction relative to the turned around location is fixed, by adhering, etc., to an edge of the inlet face Ca of the toner discharging hole W such that it can be pulled off. In this way, the toner container 32Y before starting use has the inlet face C (area to be sealed) of the toner discharging hole W sealed by the seal 39.

When starting use of the toner container 32Y, an operator grips a portion (a portion on one end side in the longitudinal direction) at which the seal 39 is exposed, which seals the inlet face Ca of the toner discharging hole W to pull it in a direction from the grip 33*d* side of the container body 33Y to the head portion side of the container body 33Y (from left to right in FIG. 8B). In this way, the turning position of the seal 39 gradually moves in a pulling out direction (from left to right in FIG. 8B), so that sealing of the inlet face Ca of the toner discharging hole W is gradually released from left to right in FIG. 8B. Then, the seal 39 is completely pulled out, so that the sealing of the inlet face Ca of the toner discharging hole W is completely released, causing the toner discharging hole W to be communicably connected with the cavity B within the cap 34Y. Then, the toner container 32Y is mounted in the toner container housing unit 70 of the present image forming apparatus 100.

At an upper portion (a ceiling portion) of the cap 34Y is formed a first hole 34*a* which is projected in the longitudinal direction from an end face of the cap 34Y on which the RFID chip 35 is provided. The first hole 34*a* becomes a main reference for positioning the cap 34Y in the present image forming apparatus 100. More specifically, a main reference pin 73*a* of the cap receiving unit 73 is inserted into the first hole 34*a* of the cap 34Y, so that it engages the first hole 34*a* in cooperation with the operation of mounting, in the longitudinal direction, the toner container 32Y in the toner container housing unit 70.

Moreover, at a lower portion (a bottom portion) of the cap 34Y is formed a second hole 34*b* which is projected in the longitudinal direction from an end face of the cap 34Y on which the RFID chip 35 is provided, which second hole 34*b* is formed such that it does not reach the toner discharging hole W. The second hole 34*b* becomes a sub reference for positioning the cap 34Y in the present image forming apparatus 100. More specifically, a sub reference pin 73*b* of the cap receiving unit 73 is inserted into the second hole 34*b* of the cap 34Y, so that it engages the second hole 34*b* in cooperation with the operation of mounting, in the longitudinal direction, the toner container 32Y in the toner container housing unit 70.

With the thus configured two holes 34*a* and 34*b*, positioning of the cap 34Y in the toner container housing unit 70 is performed.

Here, a hole depth of the first hole 34*a* (or a length of the main reference pin 73*a* in the longitudinal direction) is set longer than a hole depth of the second hole 34*b* (or a length of the sub reference pin 73*b* in the longitudinal direction). In this way, in the operation of mounting in the longitudinal direction of the toner container 32Y to the toner container housing unit 70, engaging of the main reference pin 73*a* into the first hole 34*a* to be the main positioning reference is started, after which engaging of the sub reference pin 73*b* into the second hole 34*b* to be the sub positioning reference is started, making it possible to smoothly mount the toner container 32Y in the toner container housing unit 70. Moreover, the first hole 34*a*, which is elongated in the longitudinal direction, is provided at the ceiling portion (a portion which is never buried in toner) of the cap 34Y, so that no impact occurs on toner conveyance (mobility) within the cap 34Y. Moreover, the second hole 34*b*, which is short in the longitudinal direction, is provided at the bottom portion of the cap 34Y, may be provided by using a small space from the end face of the cap 34Y to a location of the toner discharging hole W, so that a function of the sub positioning reference is sufficiently demonstrated.

On an end face of the cap 34Y is provided between the first hole 34*a* and the second hole 34*b* an RFID chip 35 in which various electronic information sets are stored. The RFID chip 35 is configured such that it opposes an antenna 73*e* of the cap receiving unit 73 at a predetermined distance with the cap 34Y being mounted in the toner container housing unit 70. Then, the RFID chip 65 conducts non-contact communication (wireless communication) with the antenna 73*e* with the cap 34Y being held in the cap receiving unit 73.

Here, in the present embodiment, as the RFID chip 35 is securely installed between the first hole 34*a* (main reference) and the second hole 34*b* (sub reference), a position of the RFID chip 35 relative to the antenna 73*e* of the cap receiving unit 73 is accurately determined. Therefore, a communications failure due to an offset of the RFID chip 35 relative to the antenna 73*e* (the RFID antenna) may be suppressed.

Now, when the toner container 32Y of the present embodiment is left for a certain time period in a relatively high temperature environment (warehouse, etc.) with the cap 34Y facing down and the toner contained inside, the toner within the cap 34 is compressed by the weight of the toner within the container body Y, such that it coheres. In this case, when mounting the toner container 32Y in the image forming apparatus body to use the toner container 32Y, a failure occurs of discharging toner to the image forming apparatus body from the toner discharging hole W provided in the cap 34Y. In the present embodiment, the toner container 32Y is mounted in the image forming apparatus body, after which the container body 33Y is rotationally driven, so that the agitating member 33*f* is rotationally driven, thereby agitating toner in the cavity (the temporary containing space) of the cap 34Y to disentangle the toner. Therefore, cohering of toner within the cavity of the cap 34Y may be prevented. However, the agitating member 33*f* does not reach an inner space C of the toner discharging hole W that is projected from the cavity B to the bottom portion, or the inner space C between an inlet face Ca of the toner discharging hole W which faces an inner wall face of the cap 34Y and an outlet face Cb of the toner discharging hole W which faces an outer wall face of the cap 34Y. Therefore, the toner which coheres within the inner space C of the toner discharging hole W continues to cohere even after the toner container 32Y is mounted to the image forming apparatus body to rotationally drive the container body 33Y. If such cohered toner is left blocking the toner discharging hole W, a failure occurs of discharging toner from the toner discharging hole W to the image forming apparatus body, on which failure there is a need to improve.

In the present embodiment, as described above, a blocking member is provided for blocking toner within the cavity B of the cap 34Y from passing through the inlet face Ca of the toner discharging hole W facing the cavity B. This blocking member is configured such that it can switch between a blocking state in which toner within the cavity B of the cap 34Y is blocked from passing through the inlet face Ca of the toner discharging hole W and a non-blocking state in which toner within the cavity B of the cap 34Y is not blocked from passing through the inlet face Ca of the toner discharging hole W. More specifically, the blocking member of the present embodiment is a seal 39, which is a sealing member for sealing the inlet face Ca (an area to be sealed) of the toner discharging hole W, causing a blocking state when the seal 39 seals the inlet face Ca of the toner discharging hole W and a non-blocking state when the seal 39 is removed from the inlet face Ca of the toner discharging hole W.

Figure 9C:
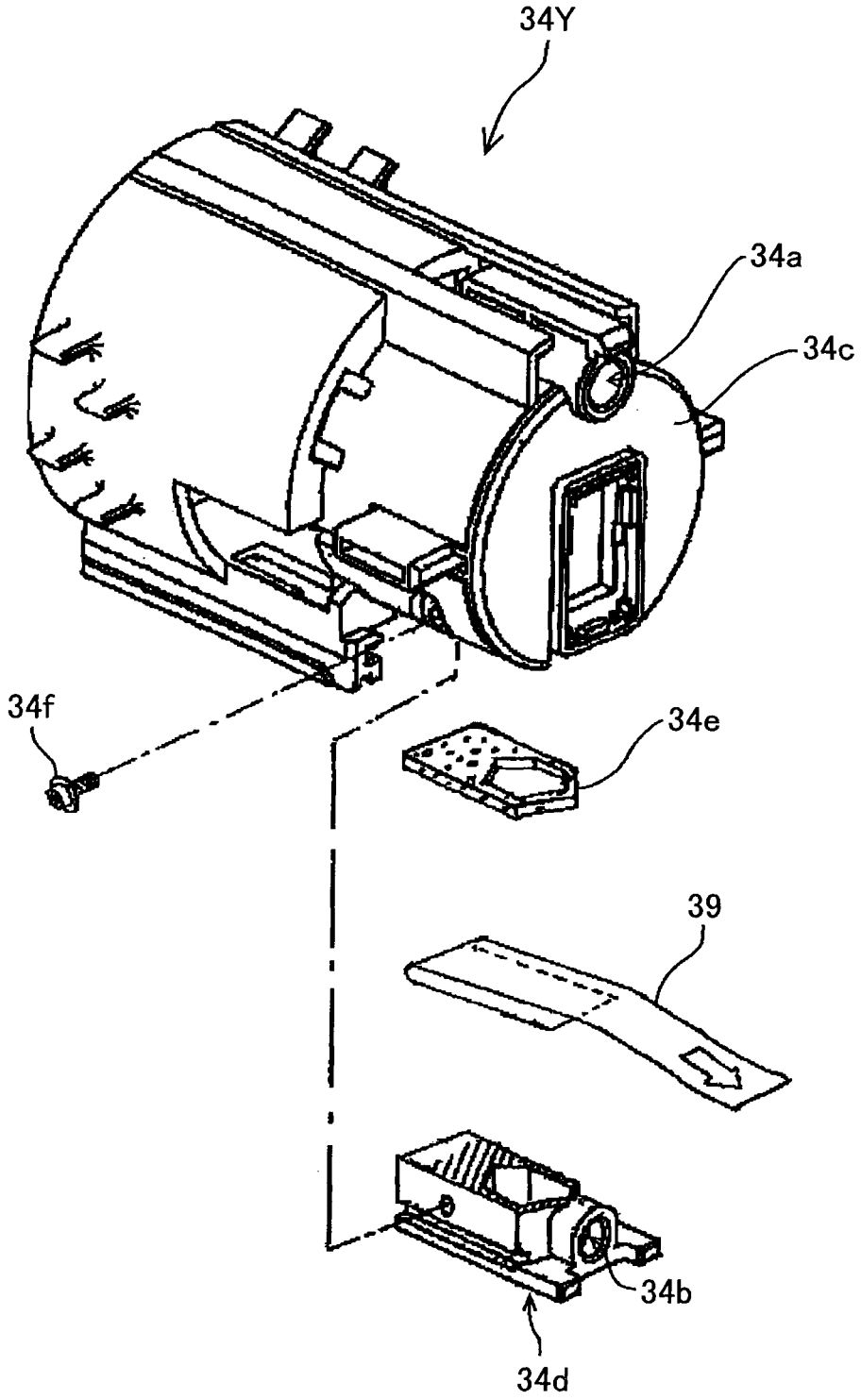
FIG. 9C is an exploded perspective view of the cap of the toner container according to another embodiment.

FIG. 9C is an exploded perspective view of the cap 34Y of the present embodiment. In FIG. 9C, the shutter 38 is not shown.

The cap 34Y according to the present embodiment includes a cap body 34*c*, and a toner discharging hole 34*d* as a discharging hole member which has a toner discharging hole W that is formed separately from the cap body 34*c*. The toner discharging hole 34*d* has formed a through hole with a hexagonal cross section, which through hole functions as the toner discharging hole W. Moreover, at this toner discharging hole 34*d* is formed a second hole 34*b*, in which a sub reference pin 73*b* is inserted when mounting the toner container 32Y to the toner container housing unit 70 of the present image forming apparatus 100. The toner discharging hole 34*d* is fitted into a fitting hole provided at the cap body 34*c* so as to be fixed to the cap body 34*c* with a fixed screw 34*f*. In this way, the cap 34Y is assembled.

In the present embodiment, the toner discharging hole 34*d* is fixed to the cap body 34*c* with the fixed screw 34*f*; however, if recycling is not taken into account, the toner discharging hole 34*d* may be fixed to the cap body 34*c* by adhering, etc.

The seal 39 is fixed by adhering, etc., onto the inner side of the cap of the toner discharging hole 34 before being installed in the cap body 34*c*. More specifically, as shown in FIG. 9C, a middle position in the longitudinal direction of the seal 39 is turned around, and a face (a face facing down in FIG. 9C) on the outer side of the turning around position on the other end in the longitudinal direction of the seal relative to the turning around position is fixed to an edge of the toner discharging hole W at a face (an upper face shown) on the inner side of the cap of the toner discharging hole 34*d*. The strength of the fixing is set to a degree such that the operator can easily pull off the seal 39 with a pulling out force.

In this way, the toner discharging hole 34*d* to which the seal 39 is fixed is installed in the cap body 34*c*. Here, the toner discharging hole 34*d* is installed in the cap body 34*c* such that one end side in the longitudinal direction of the seal 39 is positioned outside the cap 34Y. Moreover, in the present embodiment, a compressing seal 34*e* is arranged between the cap body 34*c* and the seal 39 in order to prevent toner inside the cap 34Y from leaking out of a gap between the cap body 34*c* and the seal 39. For example, the compressing seal 34*e* is fixed to the cap body 34*c* by adhering, etc., before installing the toner discharging hole 34*d* to which the seal 39 is fixed in the cap body 34*c*.

Variation 1

Next, one variation (below called "Variation 1") of the toner container 32Y of the present embodiment is described.

In the above-described embodiment, the one end side in the longitudinal direction of the seal 39 is exposed such that it projects on the outer side in the longitudinal direction of the toner container 32Y. In this case, carrying or packing the toner container 32Y could cause the seal 39 to be pulled out erroneously. More specifically, when packing an unused toner container 32Y in a cardboard box, etc., the seal 39 could erroneously be pulled out with the exposed portion of the seal 39 being caught in a lid of the cardboard box.

Figure 16:
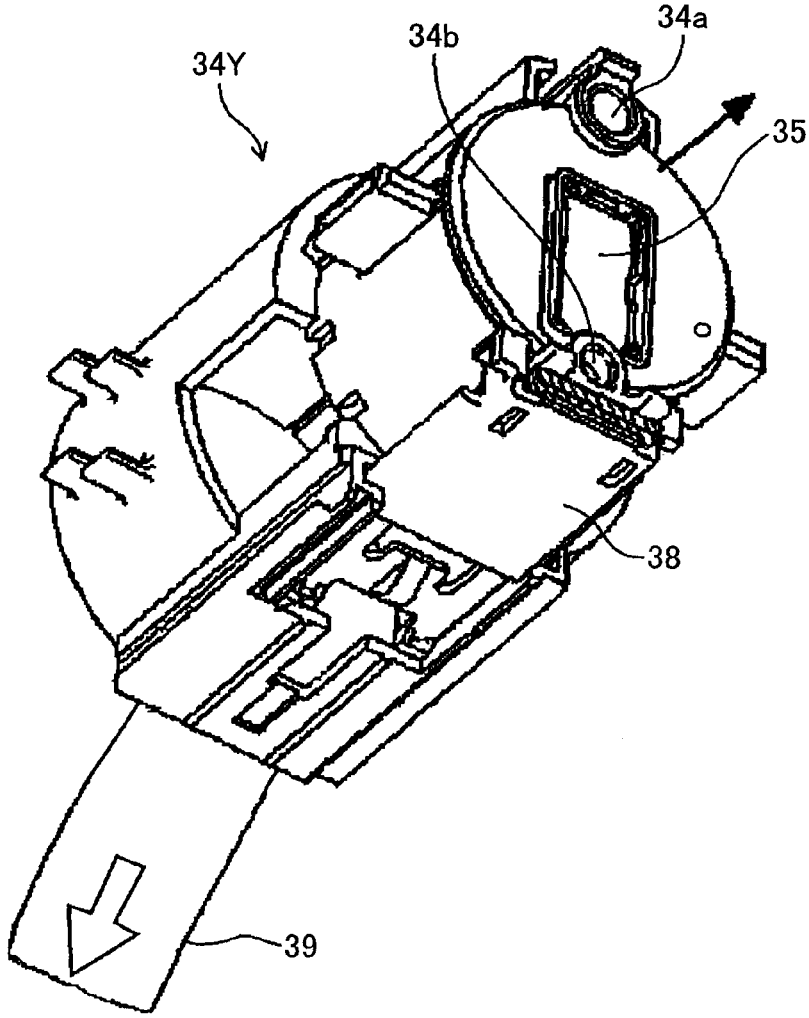
FIG. 16 is a perspective view which illustrates the toner container from an oblique bottom direction according to Variation 1.

FIG. 16 is a perspective view which illustrates the toner container 32Y from an oblique bottom direction according to the present Variation 1.

Figure 17:
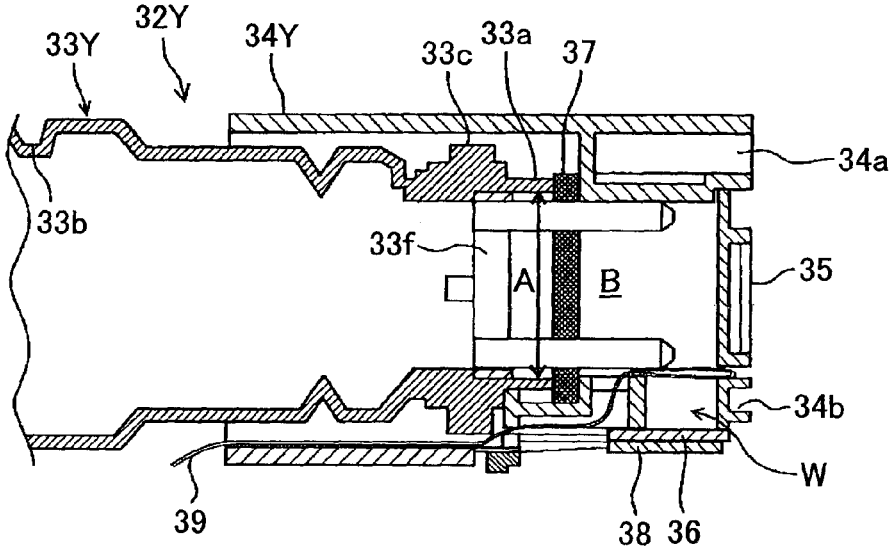
FIG. 17 is a partial cross-sectional diagram when the cap of the toner container according to the Variation 1 that is not mounted in the image forming apparatus body is partially cut along the longitudinal direction of the container body.

FIG. 17 is a partial cross-sectional diagram when the cap 34Y of the toner container 32Y according to the present Variation 1 that is not mounted in the image forming apparatus body is partially cut in the longitudinal direction of the container body 33Y.

Figure 18:
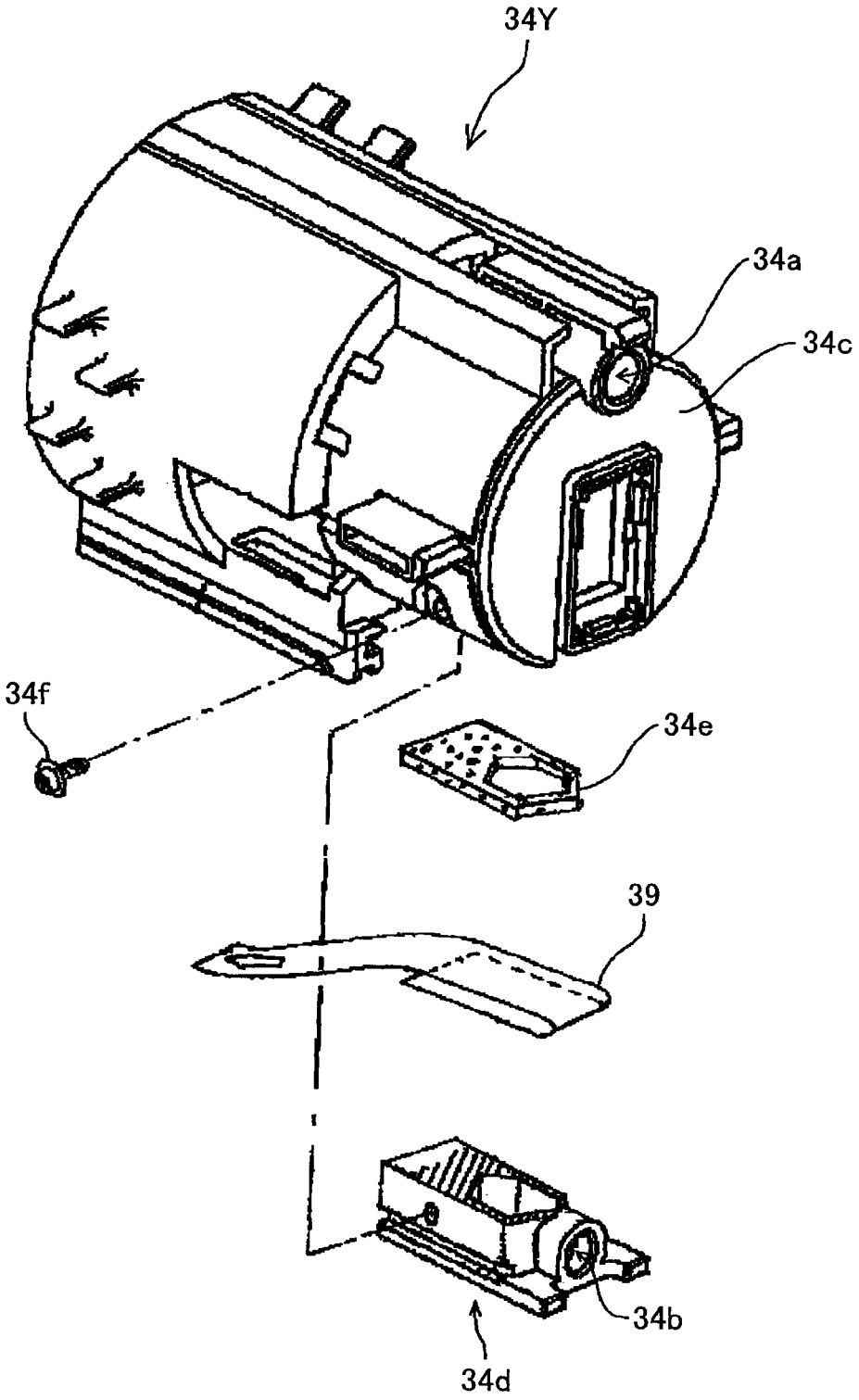
FIG. 18 is an exploded perspective view of the cap according to Variation 1.

FIG. 18 is an exploded perspective view of the cap 34Y of the present Variation 1. In FIG. 18, illustration of the shutter 38 is omitted.

In the present Variation 1, as shown in FIG. 17, the one end side in the longitudinal direction of the seal 39 is arranged such that it is pulled out to a position at which it is exposed on the bottom face side of the container body 33Y, passing through a gap between an outer wall of the container body 33Y and an inner wall of the cap 34Y. In this case, the one end side (the exposed portion) in the longitudinal direction of the seal 39 is positioned on a side face of the container body 33Y of the toner container 32Y, so that it does not project to the outer side in the longitudinal direction of the toner container 32Y. Therefore, compared to a configuration in which the one end side in the longitudinal direction of the seal 39 projects to the outer side in the longitudinal direction of the toner container 32Y, a danger is reduced that carrying or packing the toner container 32Y causes the seal 39 to be erroneously pulled out.

Moreover, in order to ensure that toner within the cap 34Y does not leak out of a gap between the cap body 34*c* and the seal 39, the compressing seal 34*e* is provided therebetween; however, when the seal 39 is pulled out vigorously, the toner within the cap 34Y is drawn out in the pulling out direction of the seal 39, which could cause the toner to fly outside the toner container 32Y. In the configuration of the embodiment as described above, the outside of the toner container 32Y and the compressing seal 34*e* are closely arranged, so that the toner may fly outside the toner container 32Y at the time of pulling out the seal 39, leading to a high likelihood of an occurrence of a failure such as the operator being stained with the toner. On the other hand, in the present Variation 1, a gap of an outer wall of the container body 33Y and an inner wall of the cap 34Y exists between the outside of the toner container 32Y and the compressing seal 34*e*. Thus, it is unlikely that the toner flies outside the toner container 32Y at the time the seal 39 is pulled out, leading to a low likelihood of an occurrence of a failure such as the operator being stained with the toner.

Variation 2

Next, another variation (below called "Variation 2") of the toner container 32Y of the present embodiment is described.

Figure 19:
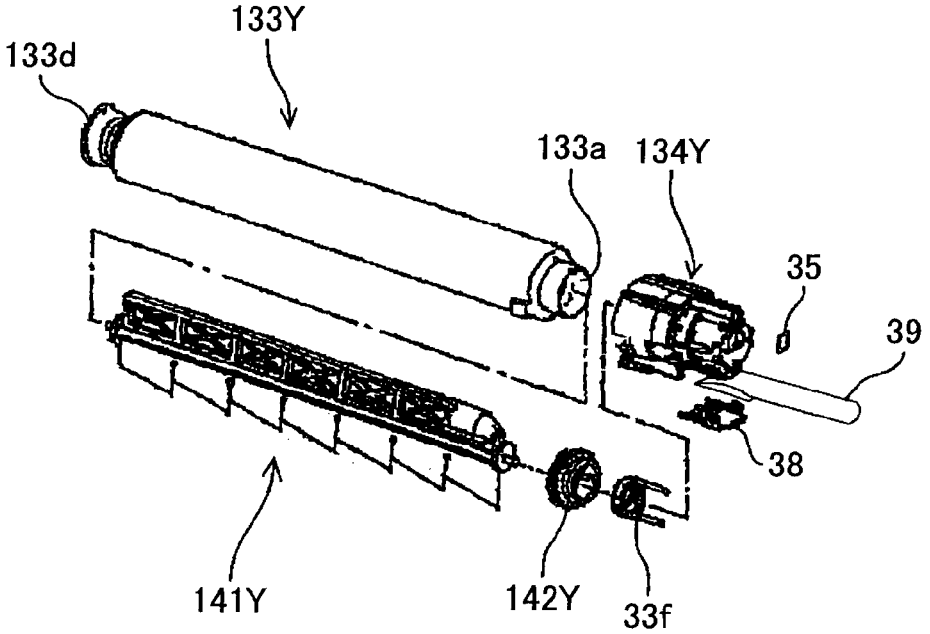
FIG. 19 is an exploded perspective diagram illustrating the toner container according to Variation 2.

FIG. 19 is an exploded perspective diagram illustrating a toner container 132Y according to Variation 2.

Figure 20:
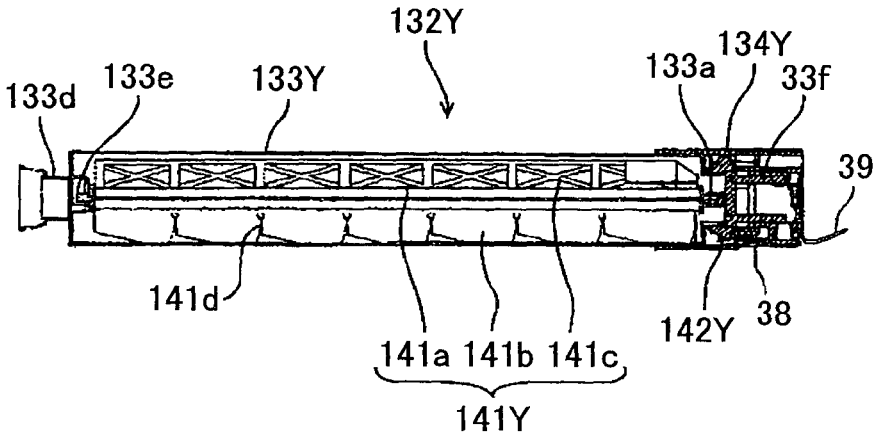
FIG. 20 is a cross-sectional diagram illustrating the toner container according to Variation 2.

FIG. 20 is a cross-sectional diagram illustrating the toner container 132Y.

The toner container 132Y in Variation 2 is different from the above described embodiment and Variation 1 in that the container body 133Y is combined with the cap 134Y of the embodiment or Variation 1 and is non-rotatably held by the toner container housing unit 70 with the cap 134Y.

With reference to FIGS. 19 and 20, similar to the embodiment and Variation 1, the toner container 132Y in the present variation 2 also includes mainly the container body 133Y and the cap 134Y provided at a head portion thereof. Here, what is different from the embodiment or Variation 1 is that, in the toner container 132Y in Variation 2, the container body 133Y is fixed to the cap 134Y with a fixing method such as adhering (or fusion), locking, etc. In other words, the container body 133Y is fixed such that it does not rotate relative to the cap 134Y.

Moreover, the container body 133Y in the present Variation 2 is different from that in the embodiment or Variation 1 in that a spiral-shaped projection is not formed on a peripheral face thereof. Moreover, in the container body 133Y, while the gear 33*c* is not integrally formed unlike the embodiment or Variation 1, the gear member 142Y and the agitating member 33*f* are installed such that they can rotate relative to the container body 133Y and the cap 134Y. Furthermore, unlike the embodiment or Variation 1, inside the container body 133Y, a conveying member 141Y for conveying, to the opening A, toner contained inside the container body 133Y has one end thereof fixed to the gear 142Y and has the other end rotatably supported by a below-described bearing 133*e* of the container body 133Y.

The cap 134Y is configured in almost the same manner as the embodiment and Variation 1 except that it is non-rotatably fixed to the container body 133Y. Moreover, the agitating member 33*f* may also be configured in almost the same manner as the embodiment or Variation 1 for the shape or function thereof except that it is not fixed to the container body 133Y, but is held by the gear member 142Y in a fixed manner.

In the present Variation 2, a grip 133*d* for a user to grip when performing an operation of mounting and detaching the toner container 132Y is also provided on the other end side in the longitudinal direction of the container body 133Y (on the reverse side of the one end side in the longitudinal direction where the cap 134Y is installed that is a back end portion in the mounting direction on the image forming apparatus body 100). The container body 133Y has formed a through hole which connects the inside and the outside, to which through hole the grip 133*d* formed of soft deformable resin such as polypropylene or polyethylene is detachably mounted. The grip 133*d*, which is for replenishing (or cleaning) toner inside the toner container 132Y (container body 133Y) at the time of manufacturing or at the time of recycling, is removed from the container body 133Y when the toner is replenished (or cleaned), and mounted on the container body 133Y after completing replenishment of the toner.

With reference to FIG. 20, the conveying member 141Y which is installed in the container body 133Y has a thin flexible agitating member 141*b* formed of a material such as Myler, etc., pasted to an axial portion 141*a* thereof and has an agitator member 141*c* on the opposite side thereof. The axial portion 141*a* of the conveying member 141Y has the end portion on the one end side in the longitudinal direction thereof locked and fixed to a coupling portion 133*g* which is provided at a rotational center of the agitating member 33*f* and has the end portion on the other end in the longitudinal direction thereof rotationally held by a bearing 133*e* (a root portion of the grip 133*d* that gets into the container body 133Y itself). Then, with the container body 133Y and the cap 134Y being non-rotationally held by the toner container housing unit 70, the agitating member 33*f* rotates with the gear member 142Y upon receiving a driving force from a drive unit 91, causing the conveying member 141Y coupled to the agitating member 33*f* at a position of the connecting portion 133*g* to also rotate. Thus, toner contained in the container body 133Y is conveyed to the cap 134Y side due to a conveying force in an axial direction of the flexible agitating member which is provided at the conveying member 141Y, while toner contained in the container body 133Y is agitated by an agitating force of the agitator member 141*c* provided at the conveying member 141Y.

The flexible agitating member 141*b* of the conveying member 141Y has formed cuts 141*d* at multiple locations (six locations in the present Variation 2) in the longitudinal direction. In this way, in conjunction with rotating of the conveying member 141Y, a tip (a free end side, which is not supported by the axial portion 141*a*) of the flexible agitating member 141*b* slidingly contacts an inner peripheral face of the container body 133Y to rotate with the flexible agitating member 141*b* being moderately twisted and bent, causing the toner contained in the container body 133Y to be agitated and conveyed to the right in FIG. 20 in the axial direction. As a result, even in the toner container 132Y in the present Variation 2, the toner is discharged from the toner discharging hole W of the cap 134Y in the same manner as in the embodiment or Variation 1.

Here, the gear member 142Y is rotationally mounted in the container body 133Y. More specifically, a gear locking portion (a snap fit pawl; not shown) which is formed at the gear member 142Y catches on a flange which is formed to run around an external peripheral face of a bottle inlet portion 133*a* of the container body 133Y, causing the gear member 142Y to be rotatably held by the container body 133Y.

Moreover, a seal material is provided between an edge face of the bottle inlet portion 133*a* and the gear member 142Y in order to prevent the toner from leaking out of the toner container 132Y. The seal material, which is made of an elastic foam material such as a polyurethane foam, is formed in a ring shape such that it cuts into an edge face of the bottle inlet 133*a* and is pasted to the gear member 142Y. Then, when the gear member 142Y is set to the container body 132Y, the seal material is pressed against an opening end face of the bottle inlet portion 133*a*, so that sealability between both members is secured.

Moreover, the gear member 142Y, which is not fixed to the cap 134Y, is rotationally held to a pawl portion of the cap 134Y. A method of holding the gear member 142Y to the cap 134Y is the same as the method of holding the cap 34Y to the bottle inlet 33*a* of the container body 33Y as described for the embodiment or Variation 1. The above-described configuration causes the container body 133Y and the cap 134Y to be connected via the gear 142Y. Moreover, the agitating member 33*f* is mounted on an inner diameter portion of the gear member 142Y. Furthermore, as described above, an axial portion 141*a* (an end portion on the one end) of the conveying member 141Y is connected to the connecting portion 133*g* of the agitating member 33*f*.

What are described in the above are exemplary, so that the present invention effects advantages for each of the following modes:

(Mode A)

A powder material container, including an elongated tubular container body 33, 133 which has formed an opening A on the one side in a longitudinal direction and which is arranged such that a powder material such as toner that is contained inside is conveyed toward the opening; and a cap 34 which has formed therein a temporary containing space which is communicably connected in the longitudinal direction of the container body to the opening of the container body to temporarily contain the powder material conveyed from the opening and which has formed on a side face in the longitudinal direction of the container body a discharging hole such as a toner discharging hole W, etc., that discharges the powder material within the temporary containing space to outside, the powder material container further including a blocking member which can switch between a blocking state in which the powder material within the temporary containing space is blocked from passing through an inlet face Ca of the discharging hole facing the temporary containing space and a non-blocking state in which the powder material within the temporary containing space is not blocked from passing through the inlet face of the discharging hole. A sealing member such as a seal 39, etc., that seals an inlet face of the discharging hole, or an area to be sealed, which area is an area on the temporary containing space side relative to the inlet face, is used as the blocking member. The sealing member is in the blocking state when sealing the area to be sealed, and is in the non-blocking state when removed from the area to be sealed.

According to the above mode, a powder material does not get into an inner space of a discharging hole due to a sealing member even when the present powder material container is left for a certain period in a relatively high-temperature environment (warehouse, etc.) with the powder material stored inside and the cap positioned to face downward, making it possible to prevent the powder material from cohering within the internal space of the discharging hole in which the powder material cannot be disentangled even when an agitating member 33*f* is used. Thus, a powder material discharging failure caused by cohering of a powder material within an internal space of a discharging hole may be prevented.

(Mode B)

In the mode A, the sealing member, which includes an elongated sheet-shaped member, is, in the blocking state, positioned such that it is turned midway in a longitudinal direction of the sheet-shaped member and has an end portion on the one side in the longitudinal direction of the sheet-shaped member relative to where it is turned to be exposed to the outside of the powder material container and a face outside where it is turned on the other end side in the longitudinal direction of the sheet-shaped member relative to where it is turned is fixed to the area to be sealed such that it can be pulled off.

The mode B makes it possible to easily pull off a sealing member from an area to be sealed with an operation of an operator gripping and pulling off an exposed portion of the sealing member.

(Mode C)

In the mode B, the cap includes a cap body 34*c*; and a discharging hole member such as a toner discharging hole 34*d*, etc., having the discharging hole formed separately from the cap body. The cap is assembled such that a face on the outside of where it is turned in the sealing member is fixed to the inner side of the cap of the discharging hole member, after which the discharging hole member is mounted on the cap body.

The mode C makes it possible to mass, produce and arrange only the discharging hole member separately from the cap body. Moreover, at the time of recycling, the discharging hole member is replaced to complete an operation of mounting the sealing member on a used powder material container, leading to an easy operation of mounting the sealing member at the time of recycling.

(Mode D)

In any one of the modes A to C, a grip (an exposed portion) which is gripped by an operator when the sealing member is removed from the area to be sealed is arranged such that it extends to outside in the longitudinal direction of the container body from one end side in the longitudinal direction of the container body on which an opening A of the container body is formed, and the sealing member is configured such that the sealing member is pulled out toward the one end side in the longitudinal direction of the container body, so that the sealing member is removed from the area to be sealed.

The above mode makes it possible to prevent a failure such that use of a powder material container is started without removing the sealing member as the grip (an exposed portion) of the sealing member is arranged at a position which is likely to attract attention of an operator.

(Mode E)

In any one of modes A to C, a grip (an exposed portion) which is gripped by an operator when a sealing member is removed from the area to be sealed is arranged such that it extends to inside in the longitudinal direction of the container body from the one end side in the longitudinal direction of the container body on which an opening of the container body is formed, and the sealing member is configured such that the sealing member is pulled out toward the other end side in the longitudinal direction of the container body, which side is a side opposite the one end side in the longitudinal direction of the container body on which the opening of the container body is formed, so that the sealing member is removed from the area to be sealed.

As described for Variation 1, a mode E reduces a likelihood of erroneously removing a sealing member when carrying or packing a powder material container relative to a configuration such that a grip (an exposed portion) of the sealing member extends to outside in the longitudinal direction of the powder material container.

(Mode F)

In any one of modes A to E, a shutter member such as a shutter 38 is further included, which can move between an open position which causes an outlet face Cb of the discharging hole facing an outer wall face of the cap to be open, and a closed position which causes the outlet face of the discharging hole to be blocked.

The mode F may prevent, by a shutter member, a powder material from leaking out of the discharging hole even after the sealing member is removed.

(Mode G)

In any of the modes A to F, an agitating member 33*f* is further included, which agitates the powder material within the temporary containing space in the cap.

The mode G tears apart, with the agitating member, a cohered powder material within a temporary containing space in a cap.

(Mode H)

In the mode G, a rotational drive unit such as a gear 33*c*, a gear member 142, etc., that rotationally drives upon receiving a drive force from outside is further included and rotational driving of the rotational drive unit drives the agitating member to agitate the powder material within the temporary containing space.

The mode G makes it possible to tear apart firmly cohered powder material with a strong agitating force.

(Mode I)

In an image forming apparatus, to which is detachably mounted a powder material container which contains a powder material used at the time of an image forming operation, a toner container 32 in any one of the modes A to H is used as the powder material container.

The mode I makes it possible to realize an image forming apparatus in which a failure to discharge powder material from a powder material container is prevented.

The present invention is not limited to the embodiments (including the variations), so it is clear that the embodiments may be changed as needed in addition to what are implied in the embodiments within the scope of technical ideas of the present invention. Moreover, the number, position, shape, etc., of the above-described constituting members are not limited to the embodiments, so that they may be set to be those suitable in embodying the present invention.

The present application is based on Japanese Priority Applications No. 2011-078430 filed on Mar. 31, 2011 and No. 2012-023809 filed on Feb. 7, 2012, the entire contents of which are hereby incorporated by reference.

The invention claimed is:

1. A powder container, comprising:

an elongated container body including an opening on one side in a longitudinal direction, the opening to convey powder from the container; and a cap including:

a containing space to contain the powder conveyed from the opening and communicatively connected in the longitudinal direction of the container body to the opening of the container body;

a discharging hole oriented to discharge the powder from the containing space in a downward direction to outside of the powder container, when the powder container is oriented to discharge into an image forming apparatus, the discharging hole including an inlet, an outlet, and a space between the inlet and outlet, the outlet being vertically aligned with the inlet; and a blocking member to switch between a blocking state and a non-blocking state, the space between the inlet and the outlet being blocked from receiving the powder in the containing space when the blocking member is in the blocking state, and the space between the inlet and the outlet not being blocked from receiving the powder in the containing space, when the blocking member is in the non-blocking state, wherein:

the blocking member comprises a seal to seal, the inlet of the discharging hole or an area that is more inside of the containing space than the inlet, the seal being in the blocking state when sealing the inlet or the area, and in the non-blocking state when removed from the inlet or the area, the seal comprises an elongated sheet and, when the seal is in the blocking state, the seal is turned midway in a longitudinal direction, an end of the elongated sheet is fixed to the inlet or the area, another end of the elongated sheet is to be pulled off from the inlet or the area, the cap further includes a cap body and a discharging hole member formed separately from the cap body, the discharging hole member including the discharging hole, and the discharging hole member is fixed to the cap body after the another end of the elongated sheet member is stuck on an inner side of the discharging hole member which faces the containing space of the cap.

2. The powder container as claimed in claim 1, the cap further comprising:

a shutter movably disposed between an open position and a closed position, the shutter opening and closing the outlet of the discharging hole, wherein the blocking member is in the non-blocking state when the shutter is in an open position, and the blocking member is in the blocking state when the shutter is in a closed position.

3. The powder container as claimed in claim 2, wherein the blocking member changes from the non-blocking state to the blocking state in cooperation with a movement of the shutter from the open position to the closed position, and the blocking member changes from the blocking state to the non-blocking state in cooperation with a movement of the shutter from the closed position to the open position.

4. The powder container as claimed in claim 2, wherein the blocking member includes a rising portion extending from an inner face of the shutter to the inlet of the discharging hole and the blocking member further includes a blocking portion arranged on a tip of the rising portion, so that the blocking portion can block the inlet of the discharging hole.

5. The powder container as claimed in claim 1, further comprising:

an agitating member which agitates the powder in the containing space of the cap.

6. The powder container as claimed in claim 5, further comprising:

a rotational driver which rotates the agitating member to agitate the powder in the containing space.

7. An image forming apparatus, comprising:

a powder container as claimed in claim 1 detachably mounted therein.

8. A powder replenishment method for replenishing a powder from the powder container as claimed in claim 1 to a powder using unit of an image forming apparatus body in which the powder container can be detachably mounted, comprising:

mounting the powder container in the image forming apparatus body when the blocking member is in the blocking state; and switching the blocking state to the non-blocking state.

9. The powder container as claimed in claim 1, wherein the seal includes a grip that protrudes outside from the cap and is to be gripped by an operator when the seal is removed from the inlet or the area.

10. The powder container as claimed in claim 1, wherein:

the seal includes a grip that extends from the cap to an end of the container body which is opposite to the opening of the container body, and the grip is to be gripped by an operator when the seal is removed from the inlet or the area.

11. The powder container as claimed in claim 1, further comprising:

a shutter movably disposed between an open position and a closed position, wherein the shutter opens the outlet of the discharging hole on an outer wall face of the cap in the open position and closes the outlet of the discharging hole in the closed position.

12. The powder container as claimed in claim 1, further comprising:

an agitator which agitates the powder in the containing space of the cap.

13. The powder container as claimed in claim 12, further comprising:

a rotational driver which rotates the agitator to agitate the powder in the containing space.

14. The powder container as claimed in claim 1, wherein:

the blocking member and a shutter are each planar, and a plane of the blocking member is parallel to a plane of the shutter.

* * * * *